US012741840B2

(12) United States Patent
Wakayama et al.

(10) Patent No.: US 12,741,840 B2
(45) Date of Patent: Sep. 22, 2026

(54) SHEET FEEDING DEVICE AND RECORDING APPARATUS

(71) Applicant: CANON KABUSHIKI KAISHA, Tokyo (JP)

(72) Inventors: Naoki Wakayama, Kanagawa (JP); Ryosuke Murata, Tokyo (JP); Ryosuke Sato, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 233 days.

(21) Appl. No.: 18/515,588

(22) Filed: Nov. 21, 2023

(65) Prior Publication Data

US 2024/0190674 A1 Jun. 13, 2024

(30) Foreign Application Priority Data

Dec. 9, 2022 (JP) ..... 2022-196826

(51) Int. Cl.
*B65H 16/08* (2006.01)

(52) U.S. Cl.
CPC ... *B65H 16/08* (2013.01); *B65H 2301/41372* (2013.01); *B65H 2801/03* (2013.01)

(58) Field of Classification Search
CPC ..... B65H 16/06; B65H 16/08; B65H 19/126; B65H 2301/41342
See application file for complete search history.

(56) References Cited

U.S. PATENT DOCUMENTS 10,150,637 B2 12/2018 Wakayama et al.
11,148,893 B2 * 10/2021 Philipse ..... B41J 15/042
11,718,113 B2 8/2023 Murata et al.
2016/0136980 A1 * 5/2016 Kobayashi ..... B65H 23/16 226/91
2018/0257408 A1 * 9/2018 Eiyama ..... B65H 16/08
2022/0105738 A1 * 4/2022 Murata ..... B41J 15/046
2023/0249481 A1 8/2023 Wakayama et al.
2024/0190145 A1 * 6/2024 Murata ..... B41J 11/0045
2024/0190674 A1 * 6/2024 Wakayama ..... B65H 19/126
(Continued)

FOREIGN PATENT DOCUMENTS

EP 2 511 209 A1 10/2012
EP 3 075 689 A1 10/2016
(Continued)

OTHER PUBLICATIONS

Extended European Search Report dated May 13, 2024, in European Patent Application No. 23211047.8.
(Continued)

*Primary Examiner* — Sang K Kim
(74) *Attorney, Agent, or Firm* — Venable LLP

(57) ABSTRACT

A sheet feeding device for feeding a sheet from a roll sheet includes a holder portion that rotatably supports the roll sheet around which the sheet to be fed is wound; a guide portion that guides the roll sheet to the holder portion; a rear member that is included in the guide portion and projects from the holder portion in a projection direction; and a front member that is included in the guide portion and is connected to the rear member to be capable of projecting from the rear member in the projection direction. The front member is configured to be movable in the projection direction with respect to the rear member.

15 Claims, 20 Drawing Sheets

(56) References Cited

U.S. PATENT DOCUMENTS

| | | | | |
|---|---|---|---|---|
| 2024/0227422 | A1* | 7/2024 | Yasuda | B41J 15/042 |
| 2025/0236480 | A1* | 7/2025 | Wakayama | B65H 16/106 |

FOREIGN PATENT DOCUMENTS

| | | | |
|---|---|---|---|
| JP | 2016-179589 | A | 10/2016 |
| JP | 2018-199582 | A | 12/2018 |
| JP | 2022-060733 | A | 4/2022 |

OTHER PUBLICATIONS

U.S. Appl. No. 18/532,073, Ryosuke Murata Naoki Wakayama Ryosuke Sato, filed Dec. 7, 2023.

* cited by examiner

X
Y
Z
9
29
4
8
24a
24c
31a
33a
31
33
D
50
40
46
R
P
A

SHEET FEEDING DEVICE AND RECORDING APPARATUS

BACKGROUND OF THE INVENTION

Field of the Invention

The present invention relates to a sheet feeding device that pulls out and feeds a sheet from a roll sheet in which the sheet is wound, and a recording apparatus that includes the sheet feeding device.

Description of the Related Art

In the related art, a recording apparatus that records an image or the like on a sheet as a recording material is provided with a sheet feeding device that rotatably supports a roll sheet and feeds a sheet. Prior to sheet feeding by the sheet feeding device, an operator sets the roll sheet in the sheet feeding device.

Japanese Patent Application Publication No. 2022-60733 discloses a configuration of a sheet feeding device that is provided with a rotating door portion for placing a roll sheet on the front side of the device to ensure the ease of mounting the roll sheet to the sheet feeding device. The rotating door portion is provided over the entire region of the sheet feeding device in a width direction, and an operator can set the roll sheet in a holder portion by attaching a spool member to the roll sheet placed on the rotating door portion and rolling the roll sheet on a guide portion formed in the rotating door portion.

SUMMARY OF THE INVENTION

A roll sheet with a large sheet size or a large number of windings is heavy, and the work of mounting a roll sheet may be hard labor, and thus it is preferable to improve the work efficiency of mounting a roll sheet.

The present invention is a further development of the above-described configuration, and an object of the present invention is to provide a sheet feeding device that improves the work efficiency of mounting a roll sheet.

To achieve the above object, a sheet feeding device of the present invention includes the following:

- a holder portion that rotatably supports the roll sheet around which the sheet to be fed is wound;
- a guide portion that guides the roll sheet to the holder portion;
- a rear member that is included in the guide portion and projects from the holder portion in a projection direction; and
- a front member that is included in the guide portion and is connected to the rear member to be capable of projecting from the rear member in the projection direction, wherein the front member is configured to be movable in the projection direction with respect to the rear member.

According to the present invention, it is possible to provide a sheet feeding device that improves the work efficiency of mounting a roll sheet.

Further features of the present invention will become apparent from the following description of exemplary embodiments with reference to the attached drawings.

DESCRIPTION OF THE EMBODIMENTS

Figure 1:
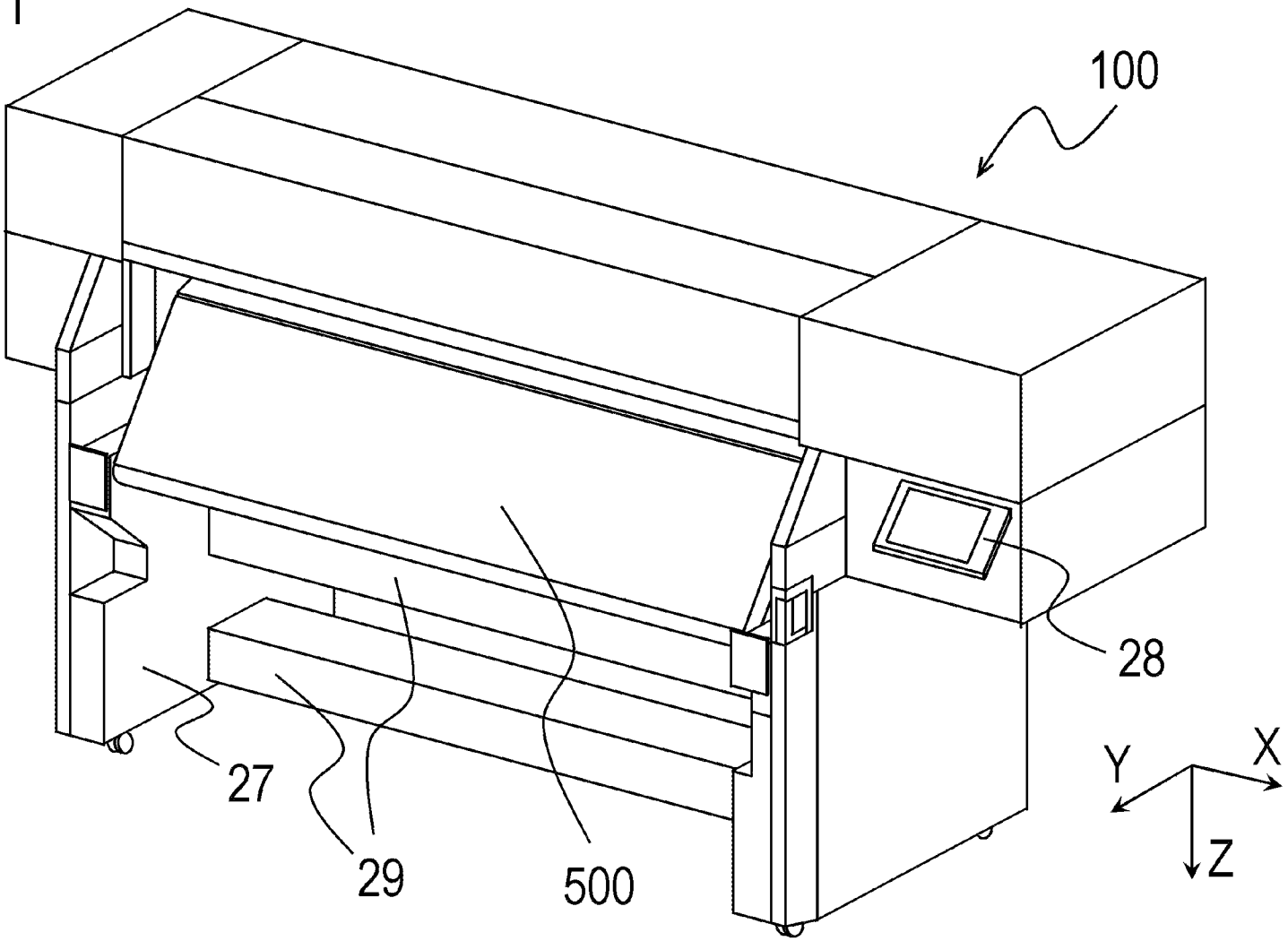
FIG. 1 is a perspective view of a recording apparatus of a first embodiment with a paper discharge guide portion in a closed state.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments are not intended to limit the scope of the invention to the following embodiments. A plurality of features are described in each of the following embodiments, but all of these features are not essential for the invention, and these features may be arbitrarily combined. In the accompanying drawings, an identical or similar composing element is denoted with a same reference numeral, and redundant description may be omitted.

First Embodiment

Recording Apparatus 100

First, a basic configuration of a recording apparatus 100 according to a first embodiment of the present invention will be described. As a recording apparatus, an inkjet recording apparatus including a sheet feeding device for feeding a sheet as a printing medium and a printing portion for printing an image on the sheet will be described as an application example. Furthermore, in this specification, "ink" is used as a general term for a liquid such as a recording liquid.

Figure 2:
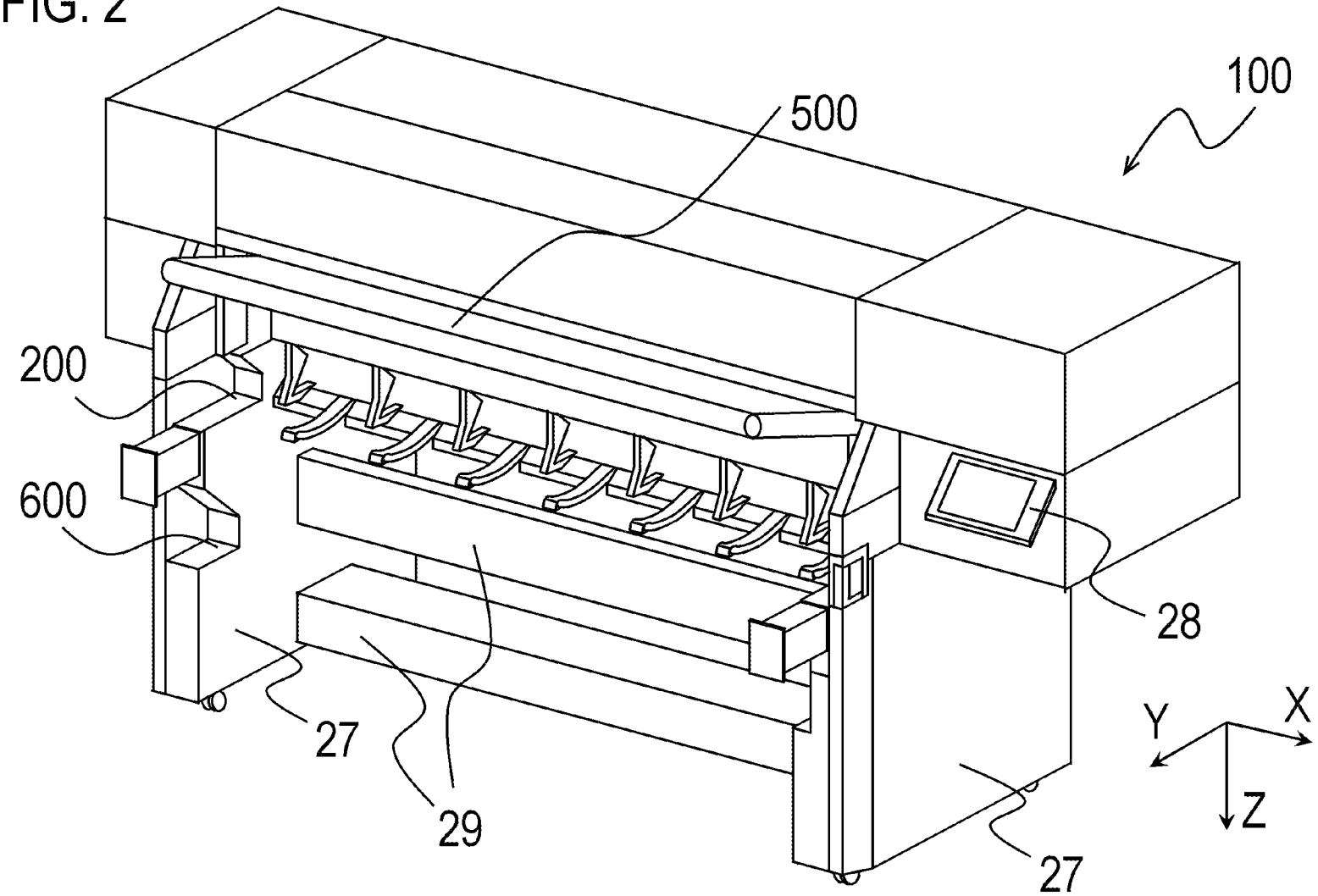
FIG. 2 is a perspective view of the recording apparatus of the first embodiment with the paper discharge guide portion in an open state.

The recording apparatus 100 includes a paper discharge guide portion 500 that is configured to be openable and closable on the front side of the recording apparatus 100. FIG. 1 is a schematic perspective view of the recording apparatus 100 with the paper discharge guide portion 500 in a closed state. FIG. 2 is a schematic perspective view of the recording apparatus 100 with the paper discharge guide portion 500 in an open state. In each drawing, a left and right direction of the recording apparatus 100 is appropriately shown as an X-axis direction, a front and rear direction of the recording apparatus 100 is shown as a Y-axis direction, and a gravity direction is shown as a Z-axis direction. In the present embodiment, the X-axis direction, the Y-axis direction, and the Z-axis direction are orthogonal to each other. Further, a roll sheet is supported by the recording apparatus 100 such that an axial direction of the roll sheet is parallel to the X-axis direction.

The recording apparatus 100 is constituted by a feeding portion that supports the roll sheet in which a sheet is wound and feeds the sheet, a printing portion (a recording portion) that performs a printing operation (a recording operation) on the fed sheet, and a winding portion that winds up the sheet on which the recording operation has been performed. As shown in FIG. 2, a roll setting portion 200 on a feeding side that supports the roll sheet and a roll setting portion 600 on a winding side are both provided on the front side of the recording apparatus 100. Further, the roll setting portion 200 on the feeding side is located above the roll setting portion 600 on the winding side. In the recording apparatus 100, the sheet is pulled out from the roll sheet supported by the roll setting portion 200 on the front side of the apparatus and is fed backward toward the printing portion. Then, the sheet on which an image has been printed by the printing portion passes through a paper discharge guide portion 500 and is wound up by the roll setting portion 600 provided on the front side of the recording apparatus 100.

When the roll sheet is set in the roll setting portion 200, the paper discharge guide portion 500 is in an open state, as shown in FIG. 2. On the other hand, during the printing operation in which an image is printed on the sheet, the paper discharge guide portion 500 is in a closed state, as shown in FIG. 1. When the paper discharge guide portion 500 is in a closed state, the sheet fed from the roll setting portion 200 passes through a sheet conveying portion, reaches the printing portion, and is discharged to the paper discharge guide portion 500 after an image has been printed on the sheet by the printing portion.

The recording apparatus 100 includes two main body leg portions 27 that support the sheet conveying portion and the printing portion described above from both sides in the left and right direction of the recording apparatus 100 and a connecting portion 29 that is provided between the two main body leg portions 27 to connect the two main body leg portions 27 to each other. The main body leg portions 27 support the sheet conveying portion, the printing portion, and the like, support the roll sheet via the roll setting portion 200, and receive a load caused by the weight of these portions. The main body leg portions 27 are in contact with a floor via casters and release the weight of the recording apparatus 100 onto the floor. The connecting portion 29 connects the two main body leg portions 27 to each other to prevent the main body leg portions 27 from falling down due to the weight.

The recording apparatus 100 also includes an operation panel 28 provided on the front side of the recording apparatus 100. The user can input various commands to the recording apparatus 100, such as specifying the size of the roll sheet and setting the type of a roll, using various switches provided on the operation panel 28.

Figure 3:
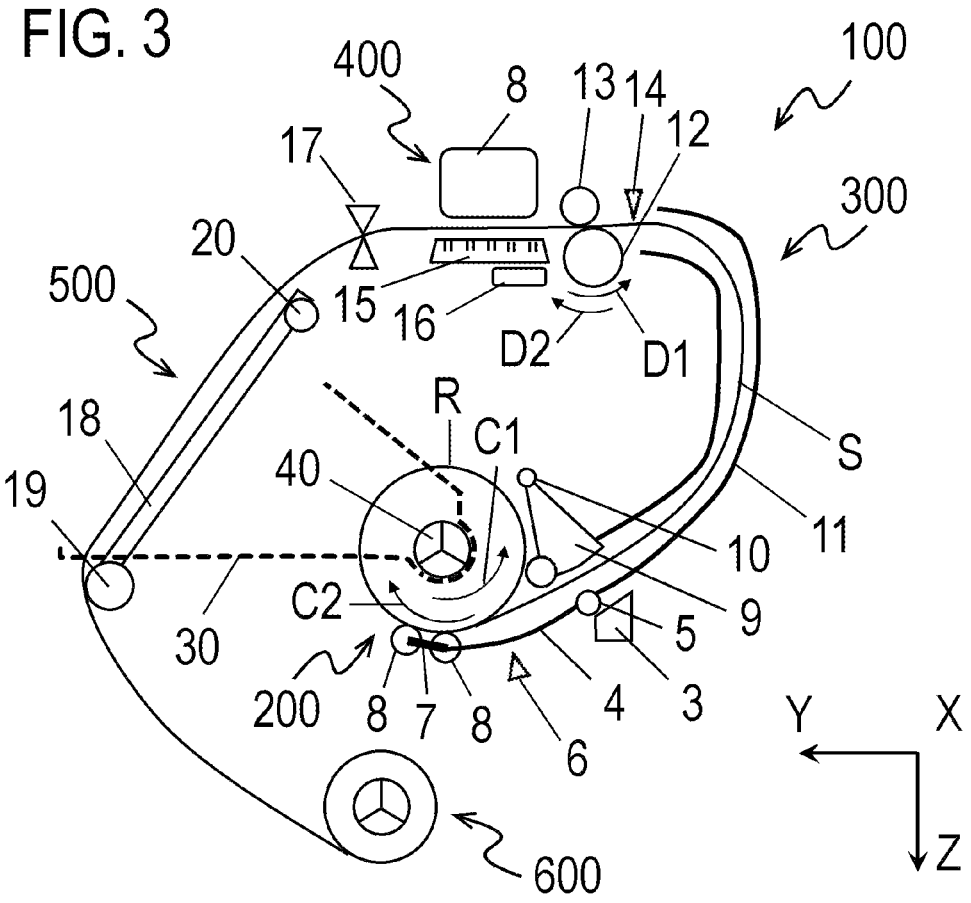
FIG. 3 is a schematic cross-sectional view of the recording apparatus of the first embodiment.

FIG. 3 is a schematic cross-sectional view of a main part of the recording apparatus 100. A sheet S pulled out from a roll sheet R set in the roll setting portion 200 on the feeding side is connected to a paper tube (a roll) set in the roll setting portion 600 on the winding side and is wound up. The recording apparatus 100 includes, in order from the upstream side in a conveyance direction of the sheet S, the roll setting portion 200 on the feeding side, a sheet conveying portion 300, a printing portion 400, the paper discharge guide portion 500, and the roll setting portion 600 on the winding side. The sheet S pulled out from the roll sheet R set in the roll setting portion 200 passes through the sheet conveying portion 300 and is conveyed to the printing portion 400 where an image can be printed. The printing portion 400 prints an image on the sheet S by ejecting ink from an inkjet printing head 23. Then, the sheet S on which an image has been printed is wound up onto the paper tube by the roll setting portion 600 while being guided by the paper discharge guide portion 500.

The printing head 23 ejects the ink from ejection ports using ejection energy generating elements such as electrothermal conversion elements (heaters) and piezo elements. The printing head 23 of the present embodiment can foam the ink using heat generated by the electrothermal conversion elements and can eject the ink from the ejection ports using the foaming energy. In applying the present invention, an ink ejection system of the printing head 23 is not limited to an inkjet system. Further, a printing system of the printing portion 400 is likewise not limited to the above-described configuration, and for example, the printing system may be a serial scan system or a full line system. In the case of the serial scan system, an image is printed on the sheet S with the conveying operation of the sheet S and the scanning by the printing head 23 in a direction intersecting with the conveyance direction of the sheet S. In the case of the full line system, a long printing head 23 extending in a direction intersecting with the conveyance direction of the sheet S is used, and an image is printed on the sheet S while the sheet S is continuously conveyed.

A shaft-shaped attachment member 40 is inserted and attached to a hollow hole portion of the roll sheet R, and the roll sheet R is supported by the roll setting portion 200 via the attachment member 40. The attachment member 40 is attached to the roll sheet R to project from both end portions of the roll sheet R in the axial direction. When the attachment member 40 is set in the roll setting portion 200, it is driven and connected to a drive source such as a roll drive motor and is driven in forward and backward rotation. Then, the attachment member 40 holding the center portion of the roll sheet R is supported by the roll setting portion 200 to be rotatable forward and backward in C1 and C2 directions (see FIG. 3) integrally with the roll sheet R.

The roll setting portion 200 includes a drive portion 3, an arm member (a moving body) 4, an arm rotation shaft 5, a first sheet sensor 6, a swinging member 7, a pressure contact member 8, a separation flapper (an upper guide body) 9, and a flapper rotation shaft 10. The roll setting portion 200 is a sheet feeding device provided in the recording apparatus 100 and can also be considered as a sheet feeding device that pulls out and feeds the sheet S from the supported roll sheet R. When the sheet S is fed, the roll sheet R rotates in the C1 direction, and the sheet S is conveyed to the sheet conveying portion 300 while being guided by the separation flapper 9 and the like.

The pressure contact member 8 is urged upward in the gravity direction, moves according to the outer diameter of the roll sheet R set in the roll setting portion 200, and presses against the outer peripheral surface of the roll sheet R from below in the gravity direction. The pressure contact member 8 is a driven rotating member configured to be rotatable in accordance with the rotation of the roll sheet R. The arm member 4 is a sheet guide member that moves in conjunction with the pressure contact member 8 and guides the lower surface of the sheet S pulled out from the roll sheet R.

The sheet conveying portion 300 includes a feeding side conveyance guide 11, a conveyance roller 12, a nip roller 13, and a second sheet sensor 14. The feeding side conveyance guide 11 guides the sheet S to the printing portion 400 while guiding the front and back surfaces of the sheet S pulled out from the roll sheet R supported by the roll setting portion 200. The conveyance roller 12 is rotated forward and backward in D1 and D2 directions (see FIG. 3) by a motor for driving the conveyance roller. The nip roller 13 can be driven to rotate according to the rotation of the conveyance roller 12 and can be moved toward and away from the conveyance roller 12 by a nip roller separation motor (not shown), and a nip force thereof can be adjusted by the nip roller separation motor. The conveyance roller 12 is rotated when the second sheet sensor 14 detects the leading edge of the sheet S. The conveyance speed of the sheet S by the conveyance roller 12 is set higher than the pulling-out speed of the sheet S due to the rotation of the roll sheet R. That is, a back tension is given to the sheet S, and thus the sheet S is conveyed in a stretched state in the conveyance direction. As a result, it is possible to prevent the sheet S from loosening and to suppress the occurrence of folds and conveyance errors of the sheet S.

The printing portion 400 includes the printing head 23, a platen 15, a suction fan 16, and a cutter 17. The platen 15 adsorbs the back surface of the sheet S through a suction hole provided in the platen 15 using a negative pressure generated by the suction fan 16. As a result, the position of the sheet S is regulated along the platen 15, and an image is printed on the sheet S with high precision by the printing head 23. The cutter 17 is located downstream of the printing head 23 in the conveyance direction of the sheet S and is configured to be able to cut the sheet S on which an image has been printed.

The paper discharge guide portion 500 includes a paper discharge conveyance guide 18, a driven roller 19, and a rotation shaft 20. The paper discharge conveyance guide 18 is a sheet guide member that guides the sheet S to the roll setting portion 600 on the winding side while guiding the back surface of the sheet S pulled out from the printing portion 400 (a surface opposite to the front surface on which the image is printed). Here, in a state in which the leading edge of the sheet S is fixed to the paper tube set in the roll setting portion 600, the set paper tube rotates according to the conveyance speed of the conveyance roller 12, and thus it is possible to continuously wind up the sheet S on which an image has been printed by the printing portion 400.

The driven roller 19 is provided at a winding side end portion of the paper discharge conveyance guide 18 (a downstream end portion of the sheet S in the conveyance direction). Since the sheet S is gently bent along the driven roller 19, damage to the sheet S is suppressed, and conveyance resistance at the bent portion is reduced, and thus it is prevented that a large deflection occurs between the conveyance roller 12 and the driven roller 19. In addition, by configuring the sheet S to follow the paper discharge conveyance guide 18 and the driven roller 19, it is possible to heat the paper discharge conveyance guide 18 by a heating portion (not shown) as needed and to assist in the thermal fixing of the ink ejected by the printing portion 400 onto the sheet S.

The rotation shaft 20 is provided at a feeding side end portion of the paper discharge conveyance guide 18 (an upstream end portion of the sheet S in the conveyance direction). The paper discharge conveyance guide 18 and the driven roller 19 are rotatable about the rotation shaft 20. When the roll sheet R is attached to and detached from the roll setting portion 200, the paper discharge guide portion 500 is rotated to be in the open state, and the paper discharge conveyance guide 18 and the driven roller 19 are retreated upward, and thus it is possible to set the roll sheet R without interference with the paper discharge guide portion 500.

Attachment Member 40

Figure 4A:
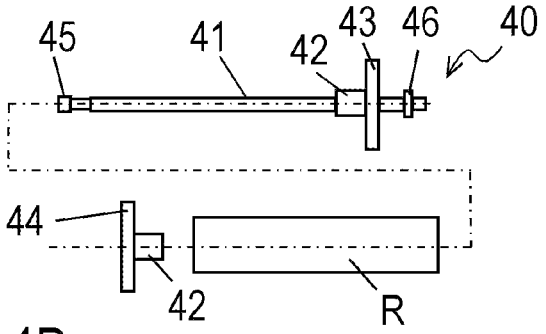
FIGS. 4A to 4C are views showing a method of attaching an attachment member of the first embodiment.
Figure 4B:
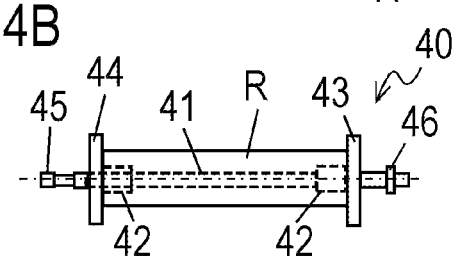
Figure 4C:
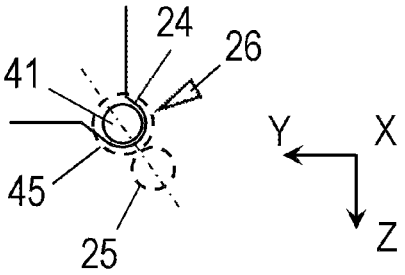

Next, the attachment member 40 that is attached to the roll sheet R when the roll sheet R is set in the roll setting portion 200 will be explained. The attachment member 40 is attached to the roll sheet R to project from both end portions of the roll sheet R in the axial direction, and the roll setting portion 200 supports the roll sheet R via the attachment member 40. FIGS. 4A, 4B, and 4C are views showing a procedure for setting the roll sheet R in the roll setting portion 200 using the attachment member 40. FIG. 4A is an exploded view of the roll sheet R and the attachment member 40. FIG. 4B is a view showing an aspect in which the attachment member 40 is fixed to the roll sheet R. FIG. 4C is a view showing an aspect in which the attachment member 40 is supported by the roll setting portion 200.

The attachment member 40 includes a spindle 41, a friction member 42, a reference flange 43, a non-reference flange 44, a spindle gear 45, and a guide shaft 46. The spindle 41 is a shaft-shaped member, the reference flange 43 and the guide shaft 46 are provided at one end of the spindle 41, and the spindle gear 45 for rotating the spindle 41 is attached to the other end of the spindle 41. Further, the non-reference flange 44 is configured to be attachable to and detachable from the spindle 41. The reference flange 43 and the non-reference flange 44 are each provided with the friction member 42 that comes into contact with the inner peripheral surface of the roll sheet R.

The outer diameters of the reference flange 43 and the non-reference flange 44 are formed larger than the outer diameter of the roll sheet R. The attachment member 40 is attached to the roll sheet R in a state in which one end of the roll sheet R is in contact with the reference flange 43 and the other end of the roll sheet R is in contact with the non-reference flange 44. Further, the spindle gear 45 has a gear portion in which a gear is formed and a non-gear portion having a diameter larger than the outer diameter of the spindle 41. The guide shaft 46 is provided on a reference side of the spindle 41 with respect to the reference flange 43 and is formed to have an outer diameter equivalent to that of the non-geared portion of the spindle gear 45. Therefore, by the spindle gear 45 and the guide shaft 46 being supported on the same plane, the roll sheet R is supported by the attachment member 40 in a state in which the axial direction of the roll sheet R is horizontal.

When the attachment member 40 is attached to the roll sheet R, the spindle 41 is inserted into the hollow hole portion of the roll sheet R in a state in which the non-reference flange 44 fitted into the spindle 41 is removed. Since the outer diameter of the spindle 41 is smaller than the inner diameter of the hollow hole portion of the roll sheet R, the operator can insert the spindle 41 into the roll sheet R with a slight force.

The spindle 41 is configured such that a gap is formed between the spindle 41 and the roll sheet R when the spindle 41 is inserted into the roll sheet R. In a state in which one end of the roll sheet R in the axial direction is in contact with the reference flange 43, the friction member 42 provided on the reference flange 43 is fitted into the hollow hole portion of the roll sheet R. Then, the friction member 42 comes into contact with the inner peripheral surface of the roll sheet R, and the reference flange 43 is fixed to the roll sheet R. Thereafter, in a state in which the non-reference flange 44 is fitted onto the spindle 41 and the other end of the roll sheet R is in contact with the non-reference flange 44, the friction member 42 provided on the non-reference flange 44 is fitted into the hollow hole portion of the roll sheet R. Then, the friction member 42 comes into contact with the inner peripheral surface of the roll sheet R, and the non-reference flange 44 is fixed to the roll sheet R.

As shown in FIG. 4B, in a state in which the spindle 41 is inserted into the roll sheet R and the roll sheet R is sandwiched between the reference flange 43 and the non-reference flange 44 in the axial direction of the roll sheet R, the attachment member 40 is attached to the roll sheet R. That is, in a state in which the attachment member 40 is attached to the roll sheet R, the reference flange 43 and the guide shaft 46 are located at one end of the roll sheet R in the axial direction, and the non-reference flange 44 and the spindle gear 45 are located at the other end of the roll sheet R in the axial direction. As shown in FIG. 4C, both end portions of the attachment member 40 in a longitudinal direction are fitted into spindle holders 24 of the roll setting portion 200, and thus the roll sheet R is set in the roll setting portion 200 via the attachment member 40.

In the first embodiment, the outer diameter of each of the reference flange 43 and the non-reference flange 44, which are spindle flanges, is about 170 mm. Further, the maximum outer diameter of the roll sheet R used in the recording apparatus 100 is approximately 180 mm, and the inner diameter of the hollow hole portion of the roll sheet R is 2 inches (50.8 mm) or 3 inches (76.2 mm). However, in applying the present invention, the outer diameter of each of the spindle flanges, the maximum outer diameter of the roll sheet R, and the inner diameter of the hollow hole portion are not limited to these numerical values.

The roll setting portion 200 includes the spindle holders 24, a drive gear 25, and a roll sensor 26. The spindle holders 24 are provided at positions corresponding to both end portions of the spindle 41 in the longitudinal direction. The inner surface of each of the spindle holders 24 is formed in a U-shape, into which the end portion of the spindle 41 can be fitted from an opening side thereof. In a state in which the attachment member 40 is fitted into the spindle holders 24, the spindle gear 45 is connected to a roll drive motor, which is a drive source, via the drive gear 25 provided in the roll setting portion 200. By driving the roll sheet R together with the attachment member 40 in forward and backward rotation by the roll drive motor, it is possible to perform the conveyance operation of the sheet S. In this way, the spindle holder 24 serves as a roll support portion that supports the roll sheet R via the attachment member 40 such that the sheet S is fed out from the roll sheet R. Further, the roll sensor 26 detects the presence or absence of the roll sheet R in the roll setting portion 200.

In this way, by using the attachment member 40 to hold the roll sheet R, it becomes possible to set the roll sheets R of different widths in the roll setting portion 200 by means of the attachment member 40 and the spindle holder 24. For this reason, the recording apparatus 100 has a configuration that allows the roll sheets R of various sizes, from large sizes such as A0 and A1 to small sizes, the width of which is equal to or less than the length of the spindle 41, to be set in the roll setting portion 200. Further, since the end portion of the roll sheet R is fitted into the reference flange 43 fixed to the spindle 41, the position of the reference side end portion of the roll sheet R is fixed with respect to the roll setting portion 200.

In the first embodiment, the attachment member 40 having the spindle 41, the reference flange 43, and the non-reference flange 44 is used as an auxiliary member for supporting the roll sheet R and setting the roll sheet R in the roll setting portion 200. However, in applying the present invention, the attachment member is not limited to the above-described configuration as long as it is configured to rotatably hold the roll sheet R in the roll setting portion 200. For example, as a simpler configuration of the attachment member, a configuration in which the attachment member is constituted only by a flange portion provided with the friction members that are fitted into both ends of the roll sheet without the spindle to rotatably support the roll sheet R is also possible. Alternatively, a configuration in which the attachment member does not have the flange and the roll sheet is fixed by a fixing mechanism provided on the spindle is also possible. However, in applying the present invention, it is preferable that the attachment member 40 have a configuration that allows it to be easily moved on a guide portion, which will be described below.

Roll Setting Portion 200

Next, a detailed configuration of the roll setting portion 200 will be explained. The roll setting portion 200 has a holder portion that rotatably supports the roll sheet R via the attachment member 40 and a guide portion that is connected to the holder portion and guides the roll sheet R to the holder portion while supporting the roll sheet R. In the first embodiment, the holder portion is constituted by the spindle holder 24. The guide portion is constituted by a first guide portion 210 and a second guide portion 220.

Figure 5:
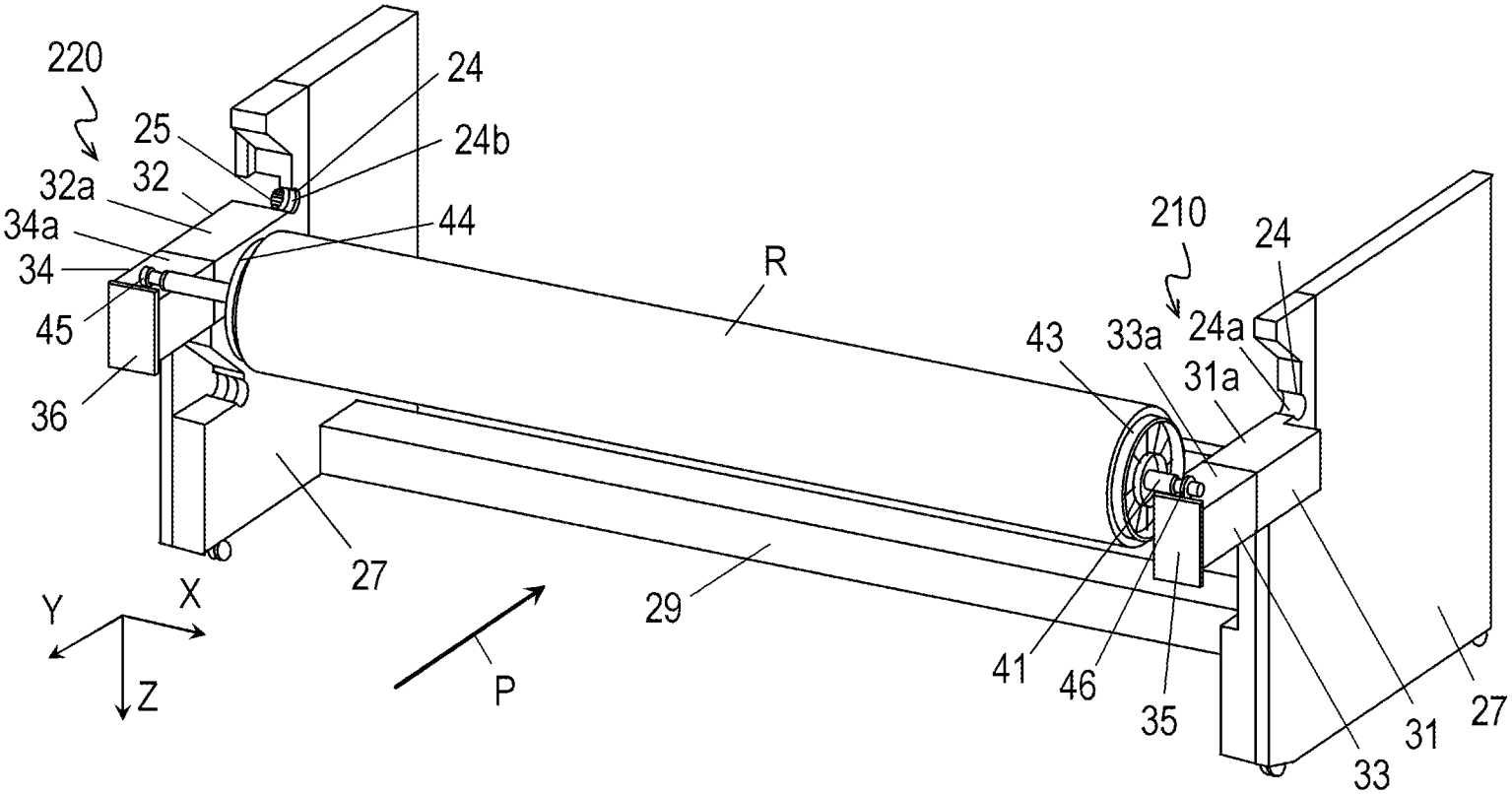
FIG. 5 is a perspective view of roll setting portions of the first embodiment.

FIG. 5 is a perspective view of the periphery of the roll setting portion 200, showing an aspect in which the attachment member 40 attached to the roll sheet R is placed on the first guide portion 210 and the second guide portion 220. The first guide portion 210 projects from the spindle holder 24 in a front direction of the recording apparatus 100 and supports the end portion of the attachment member 40 on the reference side. The second guide portion 220 projects from the spindle holder 24 in the front direction of the recording apparatus 100, faces the first guide portion 210, and supports the end portion of the attachment member 40 on a non-reference side. The first guide portion 210 and the second guide portion 220 face each other in the left and right direction (the X direction) of the recording apparatus 100. In the first embodiment, in a state in which the guide shaft 46 of the attachment member 40 is in contact with the first guide portion 210, the spindle gear 45 of the attachment member 40 is in contact with the second guide portion 220, and the axial direction of the roll sheet R is horizontal, the attachment member 40 is supported by the guide portion.

In the recording apparatus 100, the spindle holders 24 and the connecting portion 29 that connects the two main body leg portions 27 to each other are provided on the rear side with respect to the guide portion. Furthermore, when viewed in the gravity direction, the first guide portion 210 and the second guide portion 220 project from the spindle holders 24 in a projection direction opposite to a feeding direction of the sheet S. That is, no structure is provided in a space between and below the first guide portion 210 and the second guide portion 220, or in a space in front of the space.

The first guide portion 210 and the second guide portion 220 are each fixed to the main body leg portions 27. The distance between the first guide portion 210 and the second guide portion 220 is shorter than the length of the spindle 41. That is, in a state in which one end portion (a first end portion) of the attachment member 40 is placed on the first guide portion 210, the other end portion (a second end portion) of the attachment member 40 can be placed on the second guide portion 220.

The attachment member 40 attached to the roll sheet R is rolled or slid on the guide portion in a rear direction P and is guided to the spindle holder 24 by the guide portion. The spindle holder 24 has a first bearing surface 24*a* that supports the end portion of the attachment member 40 on the reference side and a second bearing surface 24*b* that supports the end portion of the attachment member 40 on the non-reference side. When the attachment member 40 is moved from the guide portion and set in the spindle holder 24, the spindle gear 45 is connected to the drive gear 25, and the attachment member 40 receives a driving force to rotate integrally with the roll sheet R.

The first guide portion 210 includes a first rear member 31 that projects forward from the spindle holder 24 and a first front member 33 that projects forward from the first rear member 31. Similarly, the second guide portion 220 includes a second rear member 32 that projects forward from the spindle holder 24 and a second front member 34 that projects forward from the second rear member 32.

The first front member 33 may be configured to be housed inside the first rear member 31 such that the first guide portion 210 is extendable and retractable in the front and rear direction of the recording apparatus 100, or may be configured to be attachable to and detachable from the first rear member 31. Similarly, the second front member 34 may be configured to be housed inside the second rear member 32 such that the second guide portion 220 is extendable and retractable in the front and rear direction of the recording apparatus 100, or may be configured to be attachable to and detachable from the second rear member 32.

In a case where the guide portion is configured to be extendable and retractable, when the roll sheet R is exchanged, by extending the first guide portion 210 and the second guide portion 220, a space D in which a carrier for carrying the roll sheet R is movable is formed to be large, and the roll sheet R can be placed on the guide portion with good work efficiency. Further, by forming the space D to be large, the carrier holding the roll sheet R having a larger diameter is allowed to enter the space D, and the roll sheet R can be placed on the guide portion. On the other hand, during the printing operation, the first guide portion 210 and the second guide portion 220 are retracted, and thus the guide portion does not disturb the operation when the operator operates the recording apparatus 100. Furthermore, the installation area of the main body of the recording apparatus 100 can be reduced, contributing to space saving. That is, since both the first guide portion 210 and the second guide portion 220 are configured to be extendable and retractable in the front and rear direction, the work efficiency of exchanging the roll sheet R can be improved without impeding the operability of the recording apparatus 100. A specific example of a configuration in which the guide portion is extendable and retractable will be described below using a second embodiment.

The guide portion of the roll setting portion 200 supports the attachment member 40 on a first guide surface of the first guide portion 210 and supports the attachment member 40 on a second guide surface of the second guide portion 220. The first guide surface is constituted by a first rear guide surface 31*a* of the first rear member 31 and a first front guide surface 33*a* of the first front member 33. The second guide surface is constituted by a second rear guide surface 32*a* of the second rear member 32 and a second front guide surface 34*a* of the second front member 34.

In the first embodiment, the first rear guide surface 31*a*, the first front guide surface 33*a*, the second rear guide surface 32*a*, and the second front guide surface 34*a* are all formed on the same plane. Since the guide surfaces that support and guide the attachment member 40 are formed on the same plane, no step is formed at a boundary between the first rear guide surface 31*a* and the first front guide surface 33*a* and a boundary between the second rear guide surface 32*a* and the second front guide surface 34*a*. Therefore, the operator can smoothly move the attachment member 40 from the guide portion to the spindle holders 24. With the guide portion configured in this way, the attachment member 40 is smoothly movable on the guide portion, and the work efficiency of mounting the roll sheet R in the roll setting portion 200 is improved.

A tip end of the first front member 33 of the first guide portion 210 is provided with a step portion 35 projecting upward from the first front guide surface 33*a*, and a tip end of the second front member 34 of the second guide portion 220 is provided with a step portion 36 projecting upward from the second front guide surface 34*a*. With the step portions 35 and 36 provided at the tip end of the guide portion, it is possible to prevent the attachment member 40 placed on the guide portion from falling forward.

Figure 6:
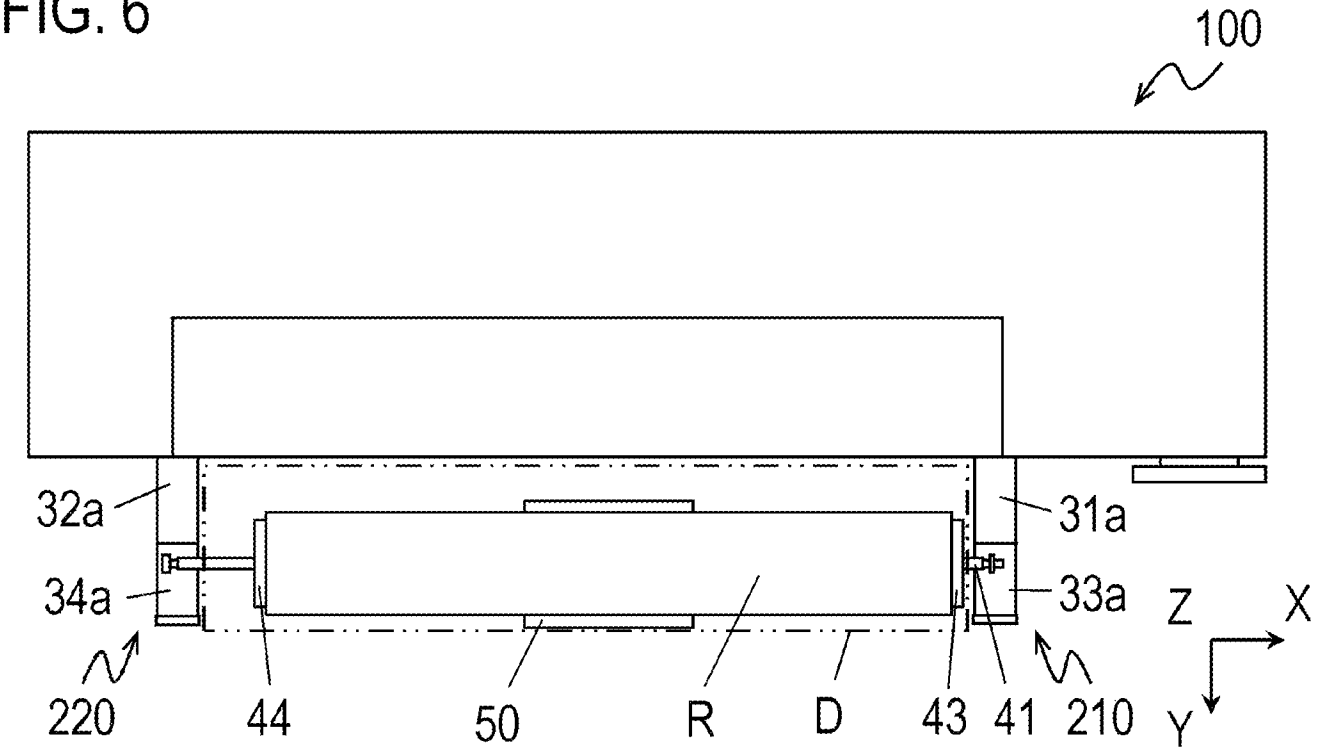
FIG. 6 is a top view of the recording apparatus, a roll sheet, and a cart of the first embodiment.
Figure 7:
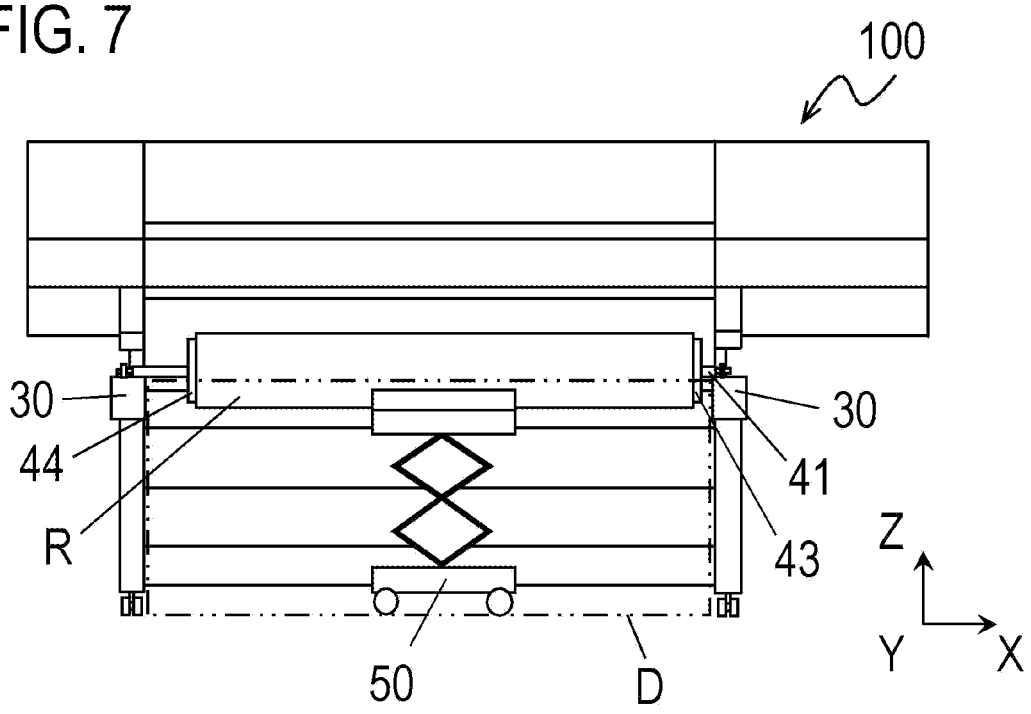
FIG. 7 is a front view of the recording apparatus, the roll sheet, and the cart of the first embodiment.

FIG. 6 is a top view of the recording apparatus 100, showing an aspect in which the attachment member 40 attached to the roll sheet R is loaded on the guide portion using a cart 50, which is a carrier. FIG. 7 is a front view of FIG. 6. In FIGS. 6 and 7, an illustration of a structural portion such as the paper discharge guide portion 500 that is retreated above the roll setting portion 200 is omitted.

As described above, a structure including the connecting portion 29 is not disposed between the first guide portion 210 and the second guide portion 220 and in the space D below them. In FIG. 6 and the like, the space D is indicated by a two-dot chain line. With such a configuration, the cart 50 can enter the space D in a state in which the cart 50 supports the roll sheet R. Furthermore, the cart 50 is movable in the space D in the front and rear direction and left and right direction of the recording apparatus 100. Therefore, according to the configuration of the first embodiment, the relative position of the roll sheet R and the attachment member 40 with respect to the guide portion can be easily adjusted by moving the cart 50 before or after the cart 50 enters the space D, and thus the work efficiency of mounting the roll sheet R is improved.

Figure 8:
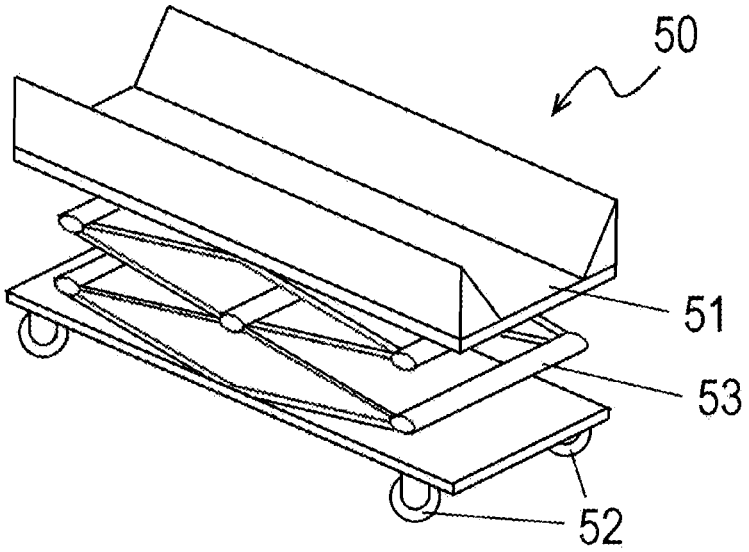
FIG. 8 is a perspective view of the cart of the first embodiment.

FIG. 8 is a perspective view of the cart 50 that carries the roll sheet R. The cart 50 is a carrier that can be suitably used for a recording apparatus or a sheet feeding device to which the present invention is applied. The cart 50 includes a receiving portion 51 that supports the roll sheet R, a wheel portion 52, and a height adjusting portion 53 that adjusts the height of the receiving portion 51. The receiving portion 51 is formed with a width that does not interfere with the guide portion when it enters the space D. The cart 50 can be freely moved on the floor by means of the wheel portion 52 provided at the lower portion. The height adjusting portion 53 provided below the receiving portion 51 is configured to be extendable and retractable in a vertical direction and moves the receiving portion 51 up and down.

The receiving portion 51 is capable of supporting the roll sheet R from below in a state in which the axial direction of the roll sheet R is horizontal, that is, in the same posture as when the roll sheet R is supported by the roll setting portion 200. Two receiving portion slopes that come into contact with the roll sheet R from below are formed in the receiving portion 51. When the receiving portion 51 supporting the roll sheet R is viewed in the axial direction of the roll sheet R, the two receiving portion slopes form a V-shape. In a state in which the roll sheet R is placed on the receiving portion 51, the roll sheet R is in contact with both of the two receiving portion slopes.

In addition, in FIGS. 6 and 7, the cart 50 is located at the central portion of the space D in the left and right direction of the recording apparatus 100, but the recording apparatus 100 is configured such that the cart 50 is movable in the space D in the left and right direction. Therefore, for example, when the roll sheet R having a smaller width is set in the roll setting portion 200, the cart 50 can be disposed in the space D closer to the first guide portion 210 on the reference side. That is, it is possible to support roll sheets R of different widths and place them on the guide portion using the same cart 50. Furthermore, according to the configuration of the recording apparatus 100, a common carrier can be used for setting roll sheets of different widths, and thus it is possible to reduce jig costs and improve work efficiency.

Method of Setting Roll Sheet

Next, a method for setting the roll sheet R in the roll setting portion 200 will be described in detail. FIGS. 9A, 9B, 9C, and 9D are views showing a procedure for placing the roll sheet R on the first guide portion 210 and the second guide portion 220 using the cart 50. FIG. 10 is a view showing a procedure for attaching the roll sheet R placed on the guide portion to the spindle holder 24. For easy understanding, in FIGS. 9A to 9D and FIG. 10, some internal constituent elements of the recording apparatus 100, such as the arm member 4 and the pressure contact member 8, are shown in a solid line.

The spindle holder 24 has the first bearing surface 24*a*, a first connection surface 24*c* that connects the first bearing surface 24*a* and the first rear guide surface 31*a* to each other, the second bearing surface 24*b*, and a second connection surface that connects the second bearing surface 24*b* and a second rear guide surface 32*a* to each other. The first connection surface 24*c* and the second connection surface are inclined downward from the front toward the rear. With this configuration, when the roll sheet is set, it becomes easy to move the roll sheet R from the guide portion to the holder portion, and it is possible to prevent the roll sheet R from unintentionally coming off the spindle holder 24.

Figures 9A, 9B, 9C, 9D:
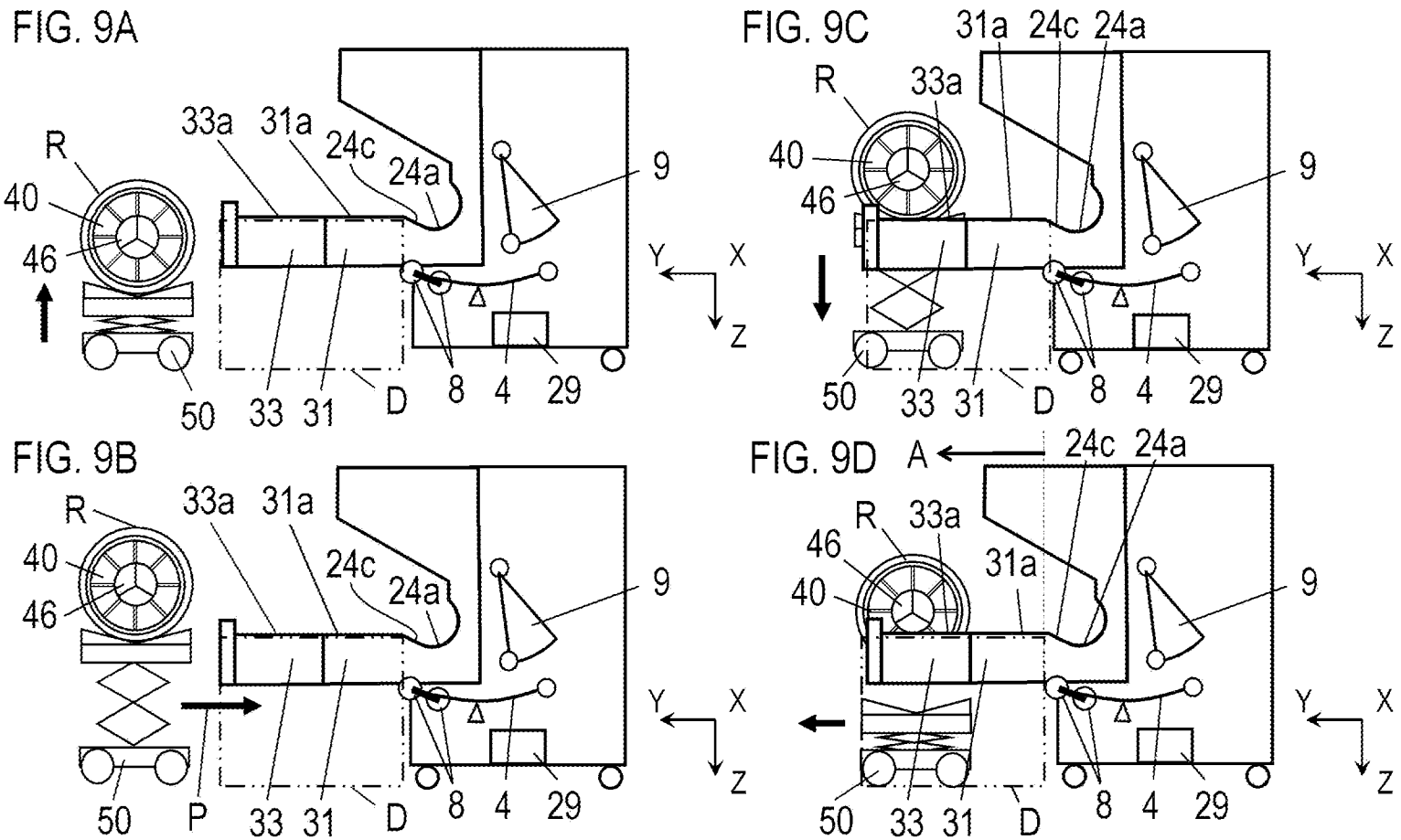
FIGS. 9A to 9D are views showing a method of setting the roll sheet of the first embodiment.
Figure 10:
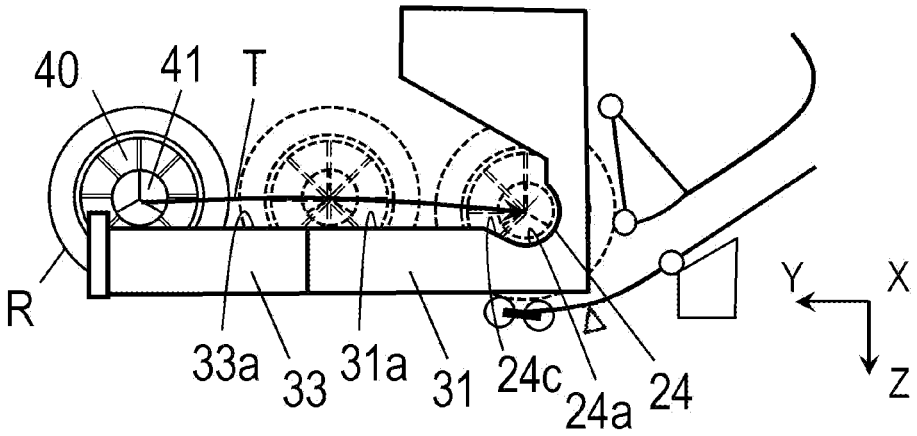
FIG. 10 is a view showing a method of guiding the roll sheet of the first embodiment.

FIG. 9A shows an aspect in which the receiving portion 51 is raised in a state in which the roll sheet R is placed on the cart 50. In order for the cart 50 supporting the roll sheet R to enter the space D, first, the receiving portion 51 is raised by the height adjusting portion 53 such that the guide shaft 46 and the spindle gear 45 which are attached to the roll sheet R are located higher than the first front guide surface 33*a* of the first front member 33. This is to prevent the attachment member 40 from interfering with the guide portion when the cart 50 enters the space D and to place the attachment member 40 on the guide portion.

FIG. 9B shows an aspect in which the cart 50 supporting the roll sheet R is moved in the direction P (the rear direction) and the cart 50 enters the space D. At this time, the cart 50 is moved until the attachment member 40 is located above the first front member 33 and the second front member 34. Further, in a case where the spindle 41 is located at a position where it does not overlap the guide portion when viewed in the gravity direction, it is necessary to move the cart 50 in the left and right direction for adjustment. The position adjustment of the spindle 41 in the left and right direction may be performed either before or after the cart 50 enters the space D.

FIG. 9C shows an aspect in which the receiving portion 51 is lowered in a state in which the spindle 41 is located above the first front member 33 and the second front member 34. At this time, the cart 50 is located in the space D in a state in which the cart 50 supports the roll sheet R. When the receiving portion 51 is lowered, one end portion of the attachment member 40 is landed on the first front member 33, the other end portion of the attachment member 40 is landed on the second front member 34, and the receiving portion 51 is separated from the roll sheet R, the transfer of the roll sheet R from the cart 50 to the guide portion is completed. That is, the operator can transfer the roll sheet R from the cart 50 to the guide portion without lifting the roll sheet R or the attachment member 40 manually. In the first embodiment, the guide shaft 46 having a larger diameter than the spindle 41 is placed on the first front guide surface 33*a* of the first front member 33, and the spindle gear 45 having a larger diameter than the spindle 41 is placed on the second front guide surface 34*a* of the second front member 34.

FIG. 9D shows an aspect in which the cart 50 is retreated from the space D in a state in which the roll sheet R is placed on the first front member 33 and the second front member 34. After the roll sheet R is placed on the first front member 33 and the second front member 34, only the cart 50 is moved forward from the recording apparatus 100, and the cart 50 is pulled out from the recording apparatus 100. Even in a case where the cart 50 is disposed in the space D, the cart 50 may remain placed in the space D if there is no problem in using the recording apparatus 100.

Here, as shown in FIG. 9C, the connecting portion 29 provided across a portion between the two main body leg portions 27 in the left and right direction is disposed on the rear side with respect to the guide portion. Therefore, when the roll sheet R is placed on the guide portion, there is no possibility that the connecting portion 29 will interfere with the roll sheet R or the cart 50. Further, as shown in FIG. 9D, since the guide portion projects from the spindle holder 24 in the front direction of the recording apparatus 100, it is possible to place the roll sheet R on the guide portion in a region on the front side with respect to the arm member 4 and the pressure contact member 8 (an arrow A in the figure). That is, when the roll sheet R is placed on the first front member 33 and the second front member 34 of the guide portion, the cart 50 does not interfere with the arm member 4 and the pressure contact member 8, and thus it is possible to place the roll sheet R on the guide portion by operating the cart 50 with good work efficiency.

As shown in FIG. 10, after the attachment member 40 is placed on the guide portion, the attachment member 40 is moved toward the spindle holder 24 while the attachment member 40 is rolled or slid integrally with the roll sheet R on the guide portion. In FIG. 10, an arrow T indicates a locus of the center of a rotation axis of the roll sheet R placed on the guide portion until the roll sheet R is supported by the spindle holder. Since the guide surface of the guide portion is configured as a flat surface without a step, it is possible to smoothly move the roll sheet R while the roll sheet R is rolled or slid on the guide surface. Therefore, the operator can easily move the roll sheet R from the guide portion to the spindle holder 24 with little force. Then, when the spindle 41 is set in the spindle holder 24, the setting of the roll sheet R in the roll setting portion 200 is completed.

As described above, in the first embodiment, it is possible to transfer the roll sheet R from the cart 50 to the guide portion and set the roll sheet R in the spindle holder 24 without lifting the roll sheet R manually. That is, it is possible to perform the carrying of the roll sheet R and the landing of the roll sheet R on the recording apparatus 100 without unloading the roll sheet R from the cart 50. Furthermore, the roll sheet R that has landed on the recording apparatus 100 can be easily moved to the spindle holder 24. Furthermore, the operator can set the roll sheet R in the roll setting portion 200 of the recording apparatus 100 with good work efficiency.

Figure 11:
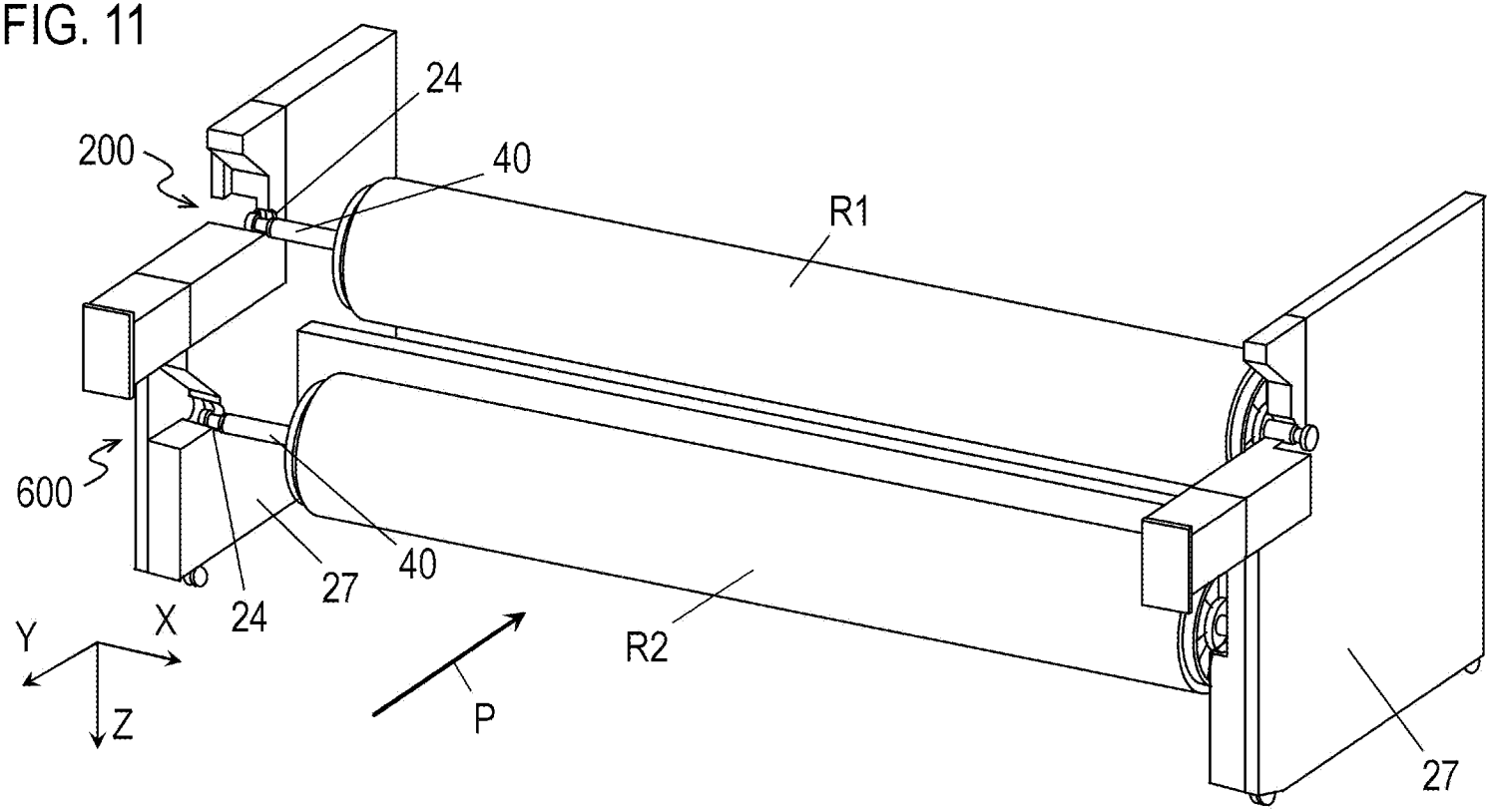
FIG. 11 is a perspective view of the roll setting portions on a feeding side and a winding side of the first embodiment.

Furthermore, in the first embodiment, a roll R2 can be removed from the roll setting portion 600 on the winding side using the cart 50. FIG. 11 is a perspective view showing an aspect in which a roll sheet is set in each of the roll setting portion 200 on the feeding side and the roll setting portion 600 on the winding side. As described above, the sheet S is fed from the roll sheet R1 supported by the roll setting portion 200 located above, and the sheet S subjected to the printing operation is wound up by the roll R2 supported by the roll setting portion 600 located below.

The roll setting portion 600 serving as the winding portion includes a holder portion that rotatably supports the roll R2 and a guide portion that guides the roll R2 to the holder portion while supporting the roll R2. The holder portion of the roll setting portion 600 is constituted by a spindle holder 24 similarly to the holder portion of the roll setting portion 200. The guide portion projects forward from the holder portion and is configured such that an attachment member 40 attached to the roll R2 can be placed thereon. The operator can move the cart 50 up and down to place the attachment member 40 on the guide portion and lift the attachment member 40 from the guide portion without lifting the roll R2 and the attachment member 40 manually.

When removing the roll sheet R from the recording apparatus 100, the above-mentioned procedure only has to be performed in reverse order. That is, even when removing the roll sheet R, the operator can transfer the roll sheet R from the guide portion to the cart 50 without lifting the roll sheet R manually. Further, the roll sheet R can be smoothly moved from the rear side to the front side of the guide portion. Furthermore, the operator can remove the roll sheet R from the recording apparatus 100 with good work efficiency.

Further, in the first embodiment, the guide portion connected to the roll setting portion 200 on the feeding side is constituted by the front member and the rear member, but the present invention is not limited to such a configuration. For example, even in a case where the first guide portion 210 and the second guide portion 220 are each made of a single member, the work efficiency of the mounting of the roll sheet R is improved as long as a space which the cart 50 can enter is formed between and below the first guide portion 210 and the second guide portion 220. Further, the roll setting portion 600 on the winding side may be provided with a guide portion similar to the roll setting portion 200 on the feeding side.

Second Embodiment

Next, a second embodiment according to the present invention will be described. The second embodiment differs from the first embodiment in the configurations of the first guide portion and the second guide portion. Hereinafter, in the description of the second embodiment, the same constituent elements as those in the first embodiment will be given the same reference signs, the description thereof will be omitted, and only the characteristic constituent elements of the second embodiment will be described. For example, the configuration of the printing portion 400 and the image forming process of the recording apparatus 100 of the second embodiment are the same as those of the first embodiment.

Roll Setting Portion

First, a roll setting portion on a feeding side of the second embodiment will be described. In the second embodiment, the roll setting portion has a holder portion (a spindle holder 24) that rotatably supports a roll sheet R via an attachment member 40 and a guide portion that is connected to the holder portion and guides the roll sheet R to the holder portion while supporting the roll sheet R. The guide portion is constituted by a first guide portion 710 and a second guide portion 720 that face each other. The first guide portion 710 and the second guide portion 720 project from the spindle holder 24 in the front direction of the recording apparatus 100, support the roll sheet R via the attachment member 40, and guide the roll sheet R to the spindle holder 24. A direction in which the first guide portion 710 and the second guide portion 720 face each other is parallel to the left and right direction of the recording apparatus 100.

Figure 12:
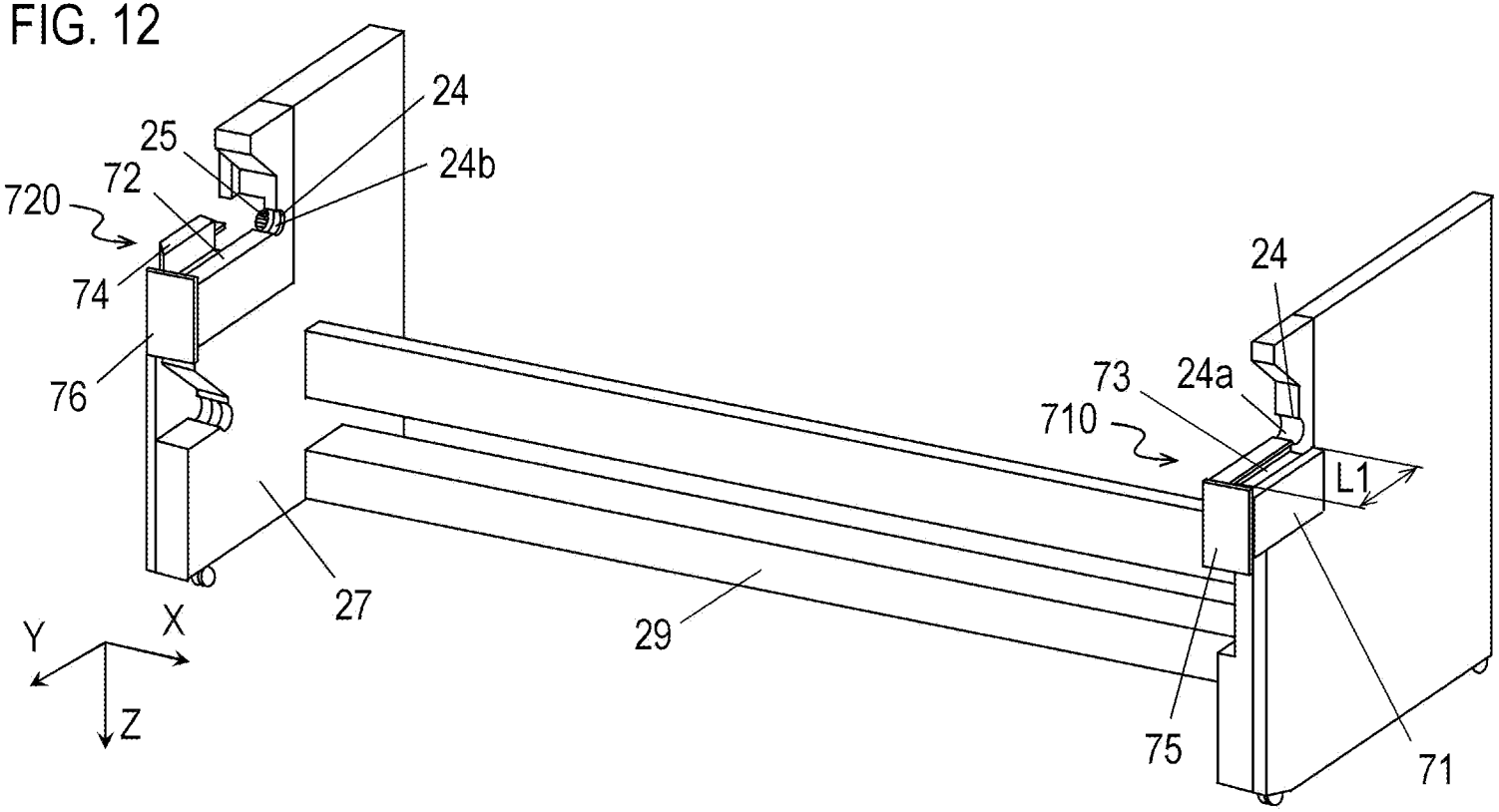
FIG. 12 is a perspective view of a guide portion in a first state of a second embodiment.
Figure 13:
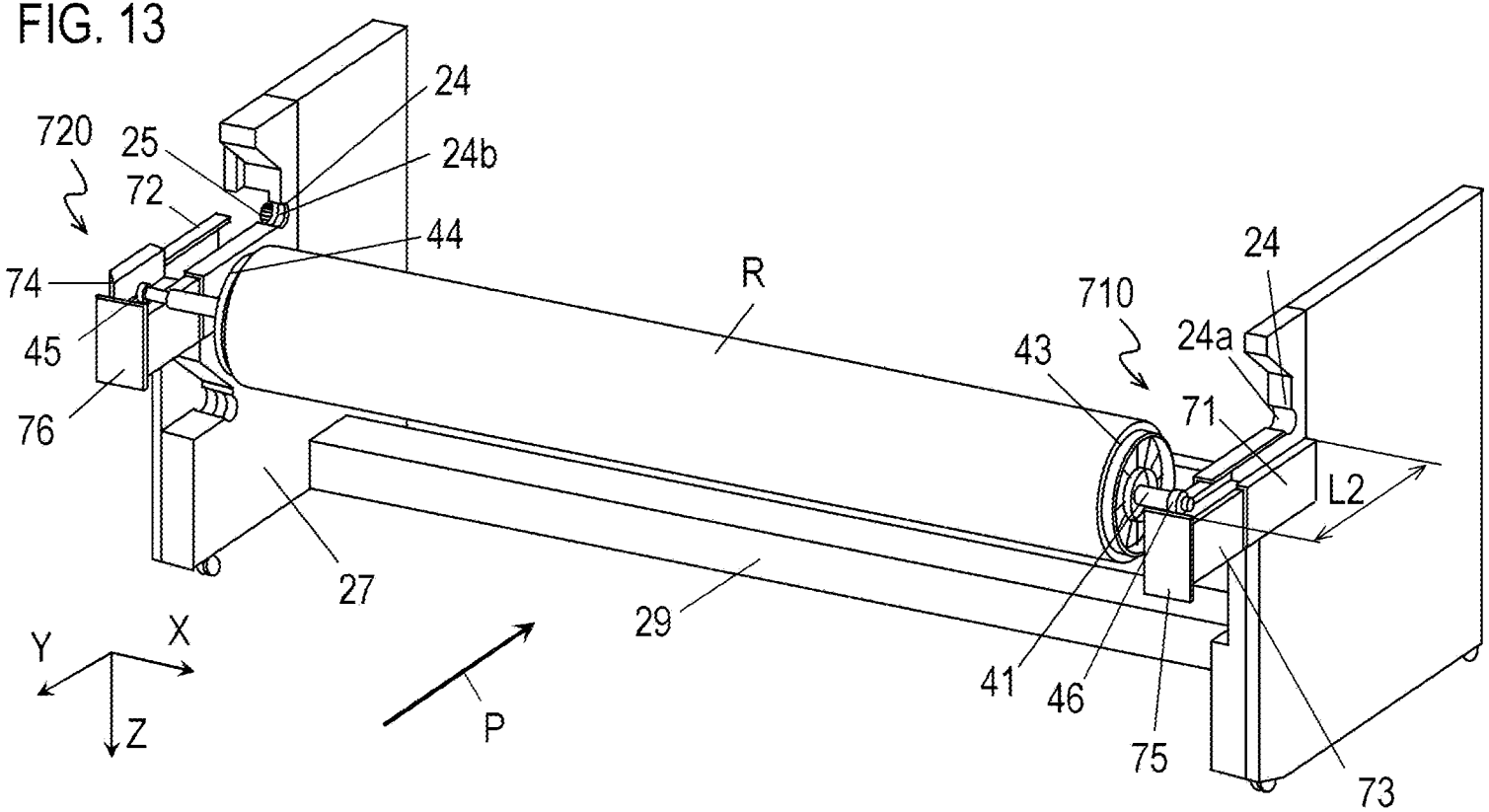
FIG. 13 is a perspective view of the guide portion in a second state of the second embodiment.
Figure 14A:
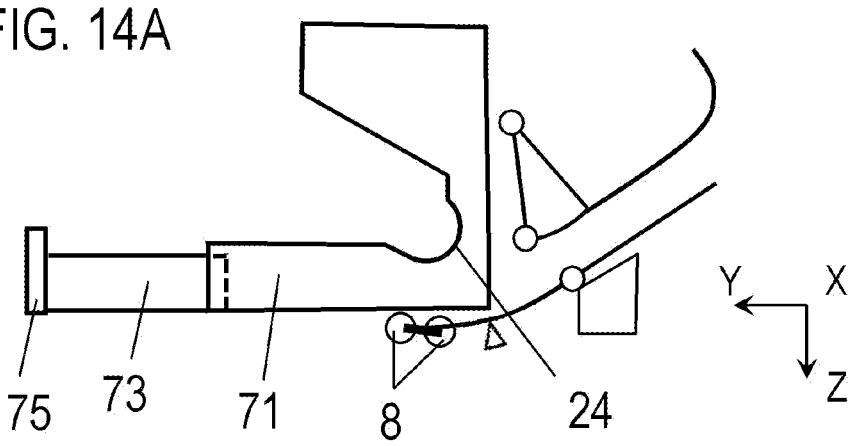
FIGS. 14A and 14B are views showing an aspect in which the guide portion of the second embodiment expands and retracts.
Figure 14B:
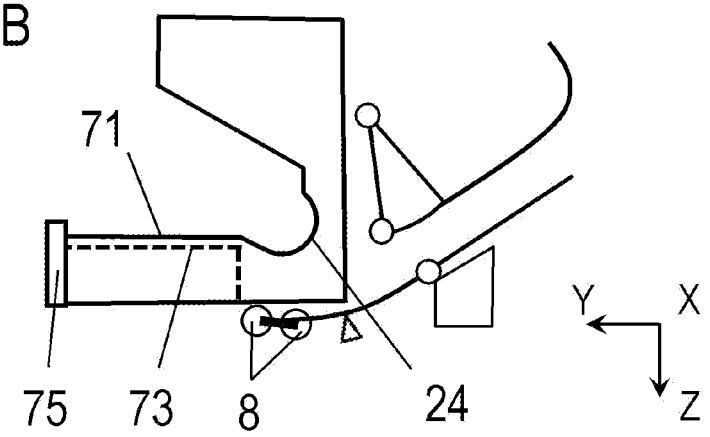

FIG. 12 is a perspective view of the periphery of the roll setting portion of the second embodiment, showing an aspect in which the attachment member 40 attached to the roll sheet R is not placed on the first guide portion 710 and the second guide portion 720. FIG. 13 is a perspective view of the periphery of the roll setting portion, showing an aspect in which the attachment member 40 is placed on the guide portion.

The first guide portion 710 includes a first rear member 71 that projects forward from the spindle holder 24 and a first front member 73 that can project forward from the first rear member 71. Similarly, the second guide portion 720 includes a second rear member 72 that projects forward from the spindle holder 24 and a second front member 74 that can project forward from the second rear member 72.

A tip end of the first front member 73 of the first guide portion 710 is provided with a step portion 75 projecting upward from an upper surface of the first front member 73, and a tip end of the second front member 74 of the second guide portion 720 is provided with a step portion 76 projecting upward from an upper surface of the second front member 74. These step portions prevent the attachment member 40 from falling from the guide portion.

The first front member 73 is configured to be slidable and movable between a position projecting forward with respect to the first rear member 71 and a position contained inside the first rear member 71. As the first front member 73 moves in the front and rear direction with respect to the first rear member 71, the first guide portion 710 extends and retracts. Similarly, the second front member 74 is configured to be slidable and movable between a position projecting forward with respect to the second rear member 72 and a position housed inside the second rear member 72. As the second front member 74 moves in the front and rear direction with respect to the second rear member 72, the second guide portion 720 extends and retracts.

As described above, each front member is configured to be movable in the front and rear direction (the projection direction and a direction opposite thereto) with respect to the corresponding rear member, and the guide portion is configured to be extendable and retractable in the front and rear direction. That is, the guide portion is deformable into a first state in which a length of projection of the guide portion from the spindle holder 24 is a first length L1 and a second state in which the length of projection is a second length L2 longer than the first length L1. When the guide portion is in the first state, the first front member 73 is housed inside the first rear member 71 and the second front member 74 is housed inside the second rear member 72. On the other hand, when the guide portion is in the second state, the first front member 73 projects forward with respect to the first rear member 71, and the second front member 74 projects forward with respect to the second rear member 72.

FIG. 12 shows an aspect in which the guide portion is in the first state. When the guide portion is in the first state, the first front member 73 is located inside the first rear member 71 and the second front member 74 is located inside the second rear member 72. Further, when the guide portion is in the first state, the step portion 75 is in contact with the tip end of the first rear member 71 and the step portion 76 is in contact with the tip of the second rear member 72. The step portion 75 may have a function as a stopper that prevents the first front member 73 from moving excessively in the rear direction.

When the guide portion is in the first state, the guide portion is retracted, and thus the guide portion does not disturb the operation when the operator operates the recording apparatus 100. Furthermore, since the guide portion is configured to be retractable, the installation area of the main body of the recording apparatus 100 can be reduced, leading to space saving.

FIG. 13 shows an aspect in which the guide portion is in the second state. When the guide portion is in the second state, the first front member 73 projects forward with respect to the first rear member 71, and the second front member 74 projects forward with respect to the second rear member 72. In the second embodiment, when the guide portion is in the second state, the front member and the rear member partially overlap each other in the front and rear direction. Further, the front member and the rear member may be provided with an engagement portion that prevents the front member from falling from the rear member when the front member is projected from the rear member.

When the guide part is in the second state, a space D formed between and below the first guide portion 710 and the second guide portion 720 is larger than the space D formed when the guide portion is in the first state. Therefore, when the guide portion is in the second state, a roll sheet R having a larger diameter can be placed on the guide portion using the cart 50 compared to when the guide portion is in the first state. Moreover, since the space D is large, the cart 50 can be moved over a wider range, and thus the operator can place the roll sheet R on the guide portion with good work efficiency. That is, since both the first guide portion 710 and the second guide portion 720 are configured to be extendable and retractable in the front and rear direction, the work efficiency of exchanging the roll sheet R can be improved without impeding the operability of the recording apparatus 100.

In a case where the diameter of the roll sheet R is small, the width of the cart 50 is small, and the roll sheet R and the cart 50 do not interfere with the recording apparatus 100, the roll sheet R and the attachment member 40 may be placed directly on the first rear member 71 and the second rear member 72 using the cart 50. In such a case, when the roll sheet R is mounted on the roll setting portion, the roll setting portion may be in the second state.

Next, the configurations of the first guide portion 710 and the second guide portion 720 will be described in more detail. When the operator rolls or slides the roll sheet R on the guide portion and the attachment member 40 integrally with each other, the roll sheet R tends to tilt in the left and right direction (the X direction) and the front and rear direction (the Y direction) directions due to a difference in pressing force on the roll sheet R in the left and right direction and the like. If the roll sheet R and the attachment member 40 move diagonally, the roll sheet R will not be set in the spindle holder 24. Therefore, the guide portion of the second embodiment is provided with a regulating portion for preventing the attachment member 40 from moving diagonally on the guide portion. Furthermore, in order to improve the work efficiency of setting the roll sheet R, the guide portion of the second embodiment is configured to be able to support the attachment member 40 and the roll sheet R at a constant height at all times.

First Guide Portion 710

Figure 15B:
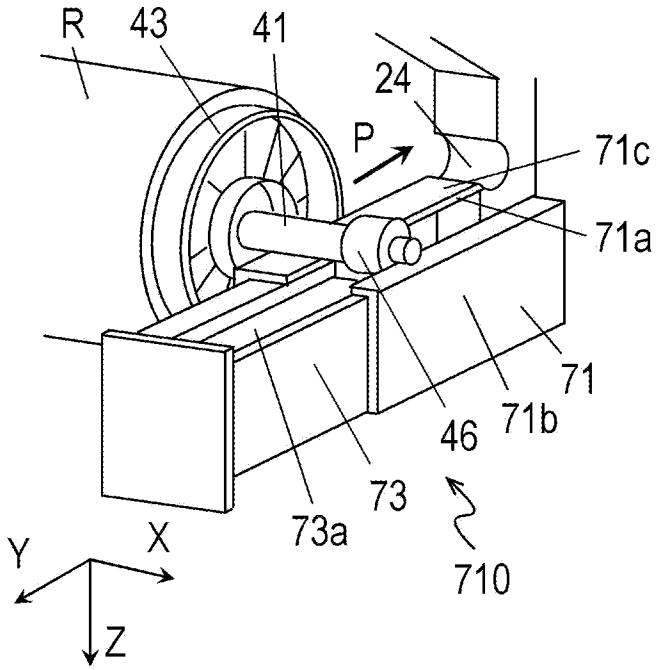
FIGS. 15A and 15B are perspective views of a first guide portion on a reference side of the second embodiment.
Figure 15A:
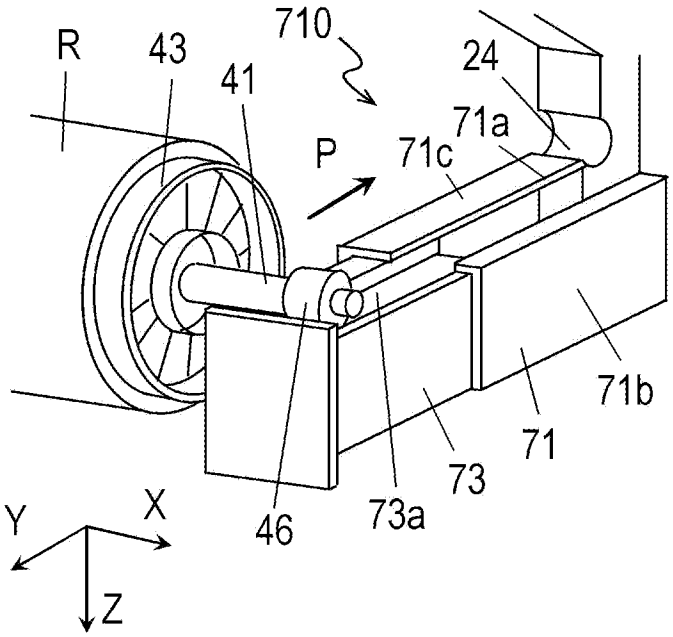
Figure 16B:
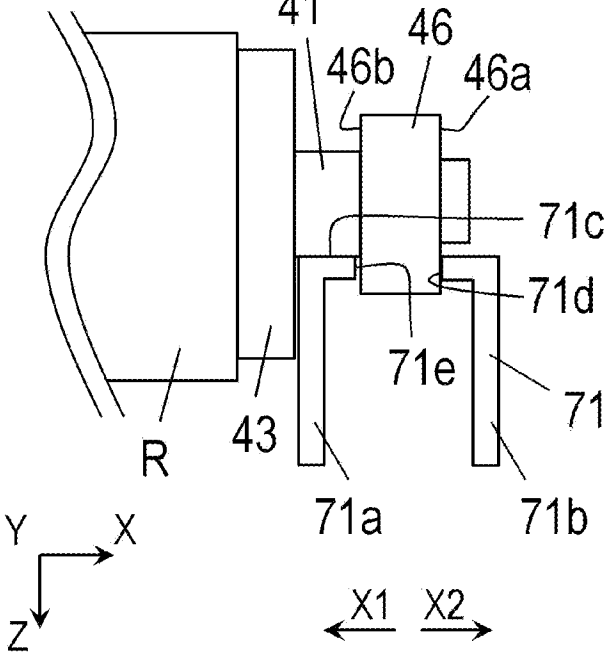
FIGS. 16A and 16B are front views of the first guide portion on the reference side of the second embodiment.
Figure 16A:
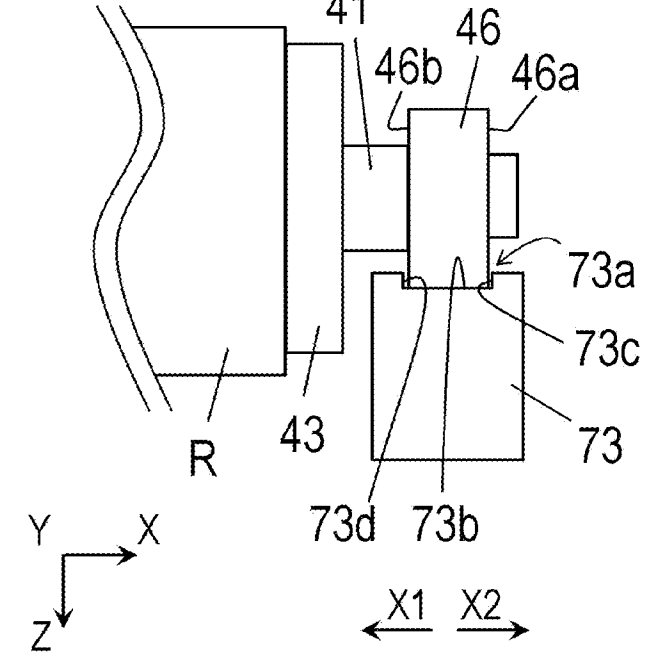
Figure 17A:
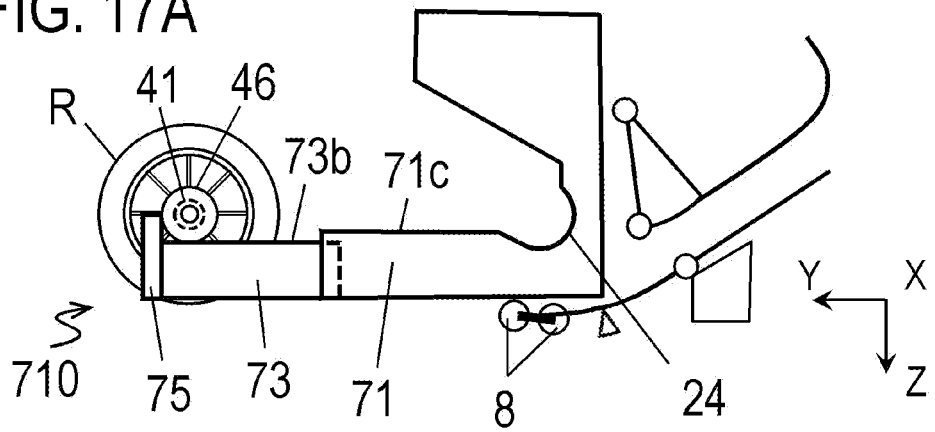
FIGS. 17A and 17B are side views of a roll setting portion on the reference side of the second embodiment.
Figure 17B:
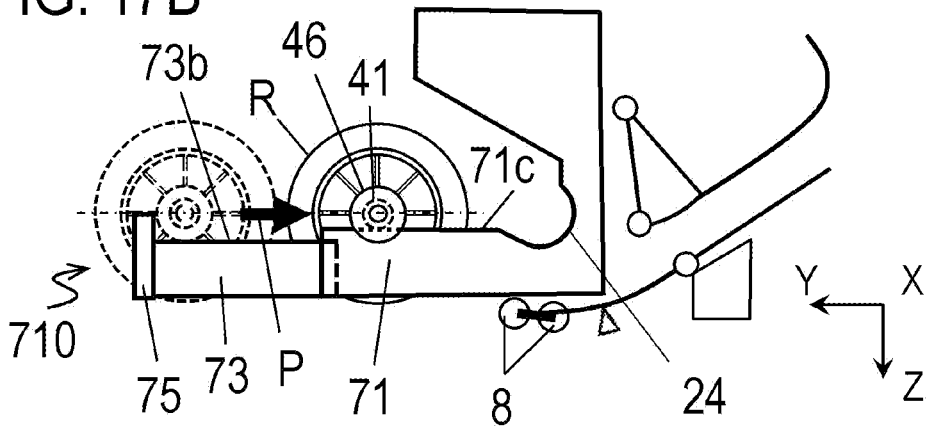

First, the configuration of the first guide portion 710 that supports the end portion of the attachment member 40 on the reference side which is attached to the roll sheet R will be described. In the following description, when one end portion of the attachment member 40 is supported by the first guide portion 710, it is assumed that the other end of the attachment member 40 is supported by the second guide portion 720. FIG. 15A is a perspective view of the first guide portion 710 that supports the attachment member 40 with the first front member 73. FIG. 15B is a perspective view of the first guide portion 710 that supports the attachment member 40 with the first rear member 71. FIG. 16A is a front view of the first front member 73 that supports the attachment member 40. FIG. 16B is a front view of the first rear member 71 that supports the attachment member 40. FIG. 17A is a side view of the first guide portion 710 that supports the attachment member 40 with the first front member 73. FIG. 17B is a side view of the first guide portion 710 that supports the attachment member 40 with the first rear member 71.

The first front member 73 is a substantially square prism member that extends in the front and rear direction (the Y direction) of the recording apparatus 100. Then, a groove 73*a* is formed in the upper surface of the first front member 73 over the entire area in the projection direction. The groove 73*a* is formed to be able to fit into the guide shaft 46 of the attachment member 40. The width of the groove 73*a* in the left and right direction is larger than the width of the guide shaft 46 in the left and right direction. That is, when the groove 73*a* and the guide shaft 46 are fitted together, a gap is formed between the groove 73*a* and the guide shaft 46 in the left and right direction.

The bottom surface of the groove 73*a* is a first front guide surface 73*b* on which the guide shaft 46 is placed when the first front member 73 supports the attachment member 40. Further, the side surfaces of the groove 73*a* are a first front regulating surface 73*c* and a second front regulating surface 73*d* that regulate the movement of the attachment member 40 in the left and right direction (the X direction) when the attachment member 40 is supported by the first front member 73. In other words, the groove 73*a* is constituted by the first front guide surface 73*b* facing upward, the first front regulating surface 73*c* facing a first direction X1 in the left and right direction, and the second front regulating surface 73*d* facing a second direction X2 in the left and right direction. The first direction X1 is a direction from the first guide portion 710 toward the second guide portion 720 in the left and right direction, and the second direction X2 is a direction opposite to the first direction X1 from the second guide portion 720 toward the first guide portion 710.

When the guide shaft 46 is placed on the first front guide surface 73*b* of the groove 73*a*, the first front regulating surface 73*c* faces an end surface 46*a* of the guide shaft 46 facing the second direction X2, and the second front regulating surface 73*d* faces an end surface 46*b* of the guide shaft 46 facing the first direction X1. With this configuration, when the attachment member 40 moves on the first front member 73, the first front member 73 prevents the attachment member 40 from moving diagonally. Furthermore, since a gap is provided between the guide shaft 46 and the groove 73*a*, the operator can place the guide shaft 46 on the groove 73*a* with good work efficiency and can smoothly move the attachment member 40 on the groove 73*a*.

In a case where the amount of the gap between the groove 73*a* and the guide shaft 46 is excessively large, the effect of preventing the attachment member 40 from moving diagonally is reduced. Therefore, it is preferable that the amount of the gap be set to a minimum value such that the width of the guide shaft 46 is not larger than the width of the groove 73*a*, taking into account the manufacturing tolerance of each member and the like.

The first rear member 71 includes an inner member 71*a* located on the center side and an outer member 71*b* located on the outer side, in the left and right direction (the X direction) of the recording apparatus 100. Both the inner member 71*a* and the outer member 71*b* are members that extend in the front and rear direction (the Y direction) of the recording apparatus 100 and have an L shape in cross section. The inner member 71*a* is disposed such that a long side of the L shape extends in the gravity direction and a short side of the L shape projects from the long side toward the outer member 71*b* in the second direction X2. On the other hand, the outer member 71*b* is disposed such that a long side of the L shape extends in the gravity direction to face the long side of the inner member 71*a* and a short side of the L shape projects from the long side toward the inner member 71*a* in the first direction X1 to face the short side of the L shape of the inner member 71*a*. That is, a space having a large width is formed between the long side of the inner member 71*a* and the long side of the outer member 71*b*, and a space having a small width is formed between the short side of the inner member 71*a* and the short side of the outer member 71*b*.

An upper surface of the inner member 71*a* is a first rear guide surface 71*c* on which a spindle 41 is placed when the attachment member 40 is supported by the first rear member 71. On the other hand, the width of the space of a facing portion between the short side of the inner member 71*a* and the short side of the outer member 71*b* is larger than the width of the guide shaft 46. That is, the attachment member 40 is placed on the first rear member 71 in a state in which the spindle 41 is in contact with the first rear guide surface 71*c* and the guide shaft 46 is fitted into the facing portion.

When the attachment member 40 is placed on the first rear member 71 and the guide shaft 46 is located between the inner member 71*a* and the outer member 71*b*, the end surfaces of the short sides of the inner member 71*a* and the outer member 71*b* face the guide shaft 46. That is, the end surface of the inner member 71*a* facing the second direction X2 and the end surface of the outer member 71*b* facing the first direction X1 each function as a regulating portion that regulates the movement of the attachment member 40 in the left and right direction. In other words, the first rear member 71 has a first rear regulating surface 71*d* that faces the first direction X1 and regulates the movement of the attachment member 40 in the second direction X2 and a second rear regulating surface 71*e* that faces the second direction X2 and regulates the movement the attachment member 40 in the first direction X1. With this configuration, when the attachment member 40 moves on the first rear member 71, the first rear member 71 prevents the attachment member 40 from moving diagonally. Furthermore, since a gap is provided between the guide shaft 46 and the first rear member 71, the operator can arrange the guide shaft 46 at the facing portion between the inner member 71*a* and the outer member 71*b* with good work efficiency and can smoothly move the attachment member 40 on the first rear guide surface 71*c*.

In a case where the amount of the gap between the first rear member 71 and the guide shaft 46 is large, the effect of preventing the attachment member 40 from moving diagonally is reduced. Therefore, it is preferable that the amount of the gap be set to a minimum value such that the width of the guide shaft 46 is not larger than the facing width between the short side of the inner member 71*a* and the short side of the outer member 71*b*, taking into account the manufacturing tolerance of each member and the like.

As described above, the first guide portion 710 has the first front regulating surface 73*c* and the first rear regulating surface 71*d* that regulate the movement of the attachment member 40 in the second direction X2 and the second front regulating surface 73*d* and the second rear regulating surface 71*e* that regulate the movement of the attachment member 40 in the first direction X1. In other words, the first guide portion 710 has a first regulating portion (the first front regulating surface 73*c* and the first rear regulating surface 71*d*) that regulates the movement of the attachment member 40 in the second direction X2 across the first rear member 71 and the first front member 73. Similarly, the first guide portion 710 has a second regulating portion (the second front regulating surface 73*d* and the second rear regulating surface 71*e*) that regulates the movement of the attachment member 40 in the first direction X1 across the first rear member 71 and the first front member 73. With this configuration, the first guide portion 710 guides the attachment member 40 to the spindle holder 24 on the first guide portion 710 in the direction P while preventing the attachment member 40 from moving diagonally. Furthermore, the operator can set the roll sheet R in the roll setting portion with good work efficiency.

Further, as described above, the first front member 73 supports the guide shaft 46 on the first front guide surface 73*b*, and the first rear member 71 supports the spindle 41 on the first rear guide surface 71*c*. Regardless of the position of the first front member 73, the first front guide surface 73*b* is formed to at least partially overlap the first rear guide surface 71*c* in the front and rear direction (the Y direction). With this configuration, even while the attachment member 40 moves from above the first front member 73 to above the first rear member 71, the attachment member 40 continues to be supported by the first guide portion 710 at all times.

Further, the first front guide surface 73*b* and the first rear guide surface 71*c* are formed at positions shifted from each other in the gravity direction (the Z direction) and the left and right direction (the X direction). In other words, the first front guide surface 73*b* and the first rear guide surface 71*c* support the attachment member 40 at different positions in the gravity direction (the Z direction) and the left and right direction (the X direction).

The first guide portion 710 is configured such that a height (a distance in the gravity direction) from the first front guide surface 73*b* to the first rear guide surface 71*c* is equal to a difference between a radius of the guide shaft 46 (a first shaft portion) and a radius of the spindle 41 (a second shaft portion) of the attachment member 40. With this configuration, the first front member 73 can support the roll sheet R and the attachment member 40 at the same height as the roll sheet R and the attachment member 40 supported by the first rear member 71. Furthermore, the attachment member 40 continues to be supported by the first guide portion 710 at a constant height at all times regardless of its position in the front and rear direction. Therefore, when the operator moves the attachment member 40 from above the first front member 73 to above the first rear member 71, the attachment member 40 moves smoothly without being caught by the first rear member 71. Similarly, when the operator moves the attachment member 40 from above the first rear member 71 to above the first front member 73, the attachment member 40 moves smoothly without being caught by the first front member 73. Furthermore, the operator can set and remove the roll sheet R with respect to the roll setting portion with good work efficiency.

Second Guide Portion 720

Figure 18B:
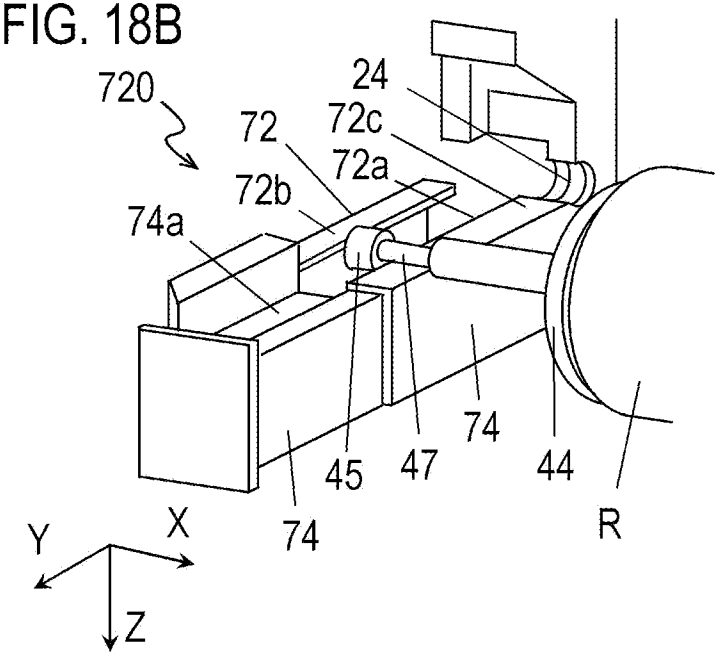
FIGS. 18A and 18B are perspective views of a second guide portion on a non-reference side of the second embodiment.
Figure 18A:
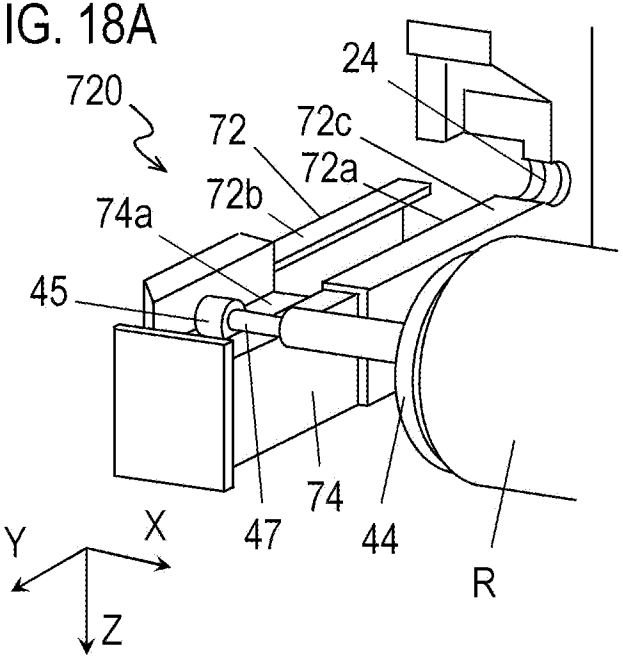
Figure 19B:
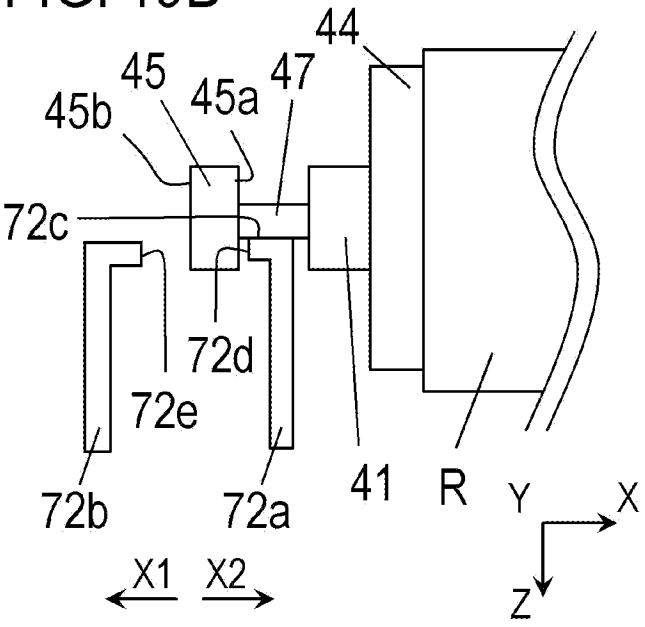
FIGS. 19A and 19B are front views of the second guide portion on the non-reference side of the second embodiment.
Figure 19A:
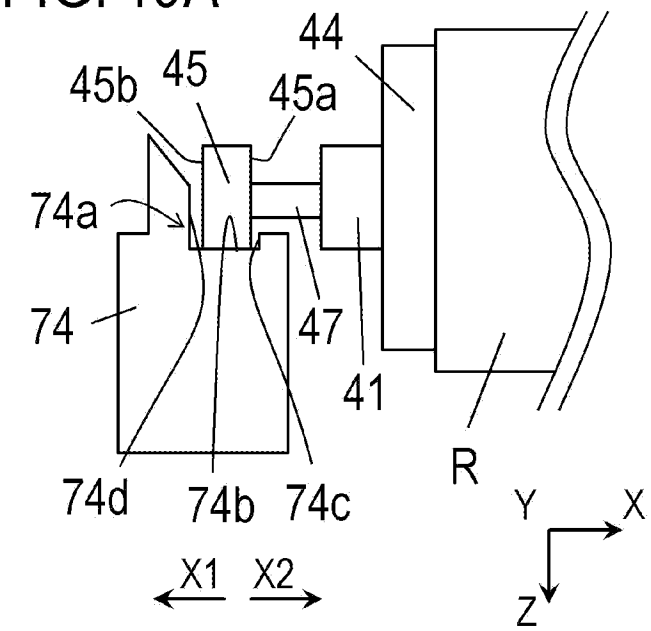
Figure 20A:
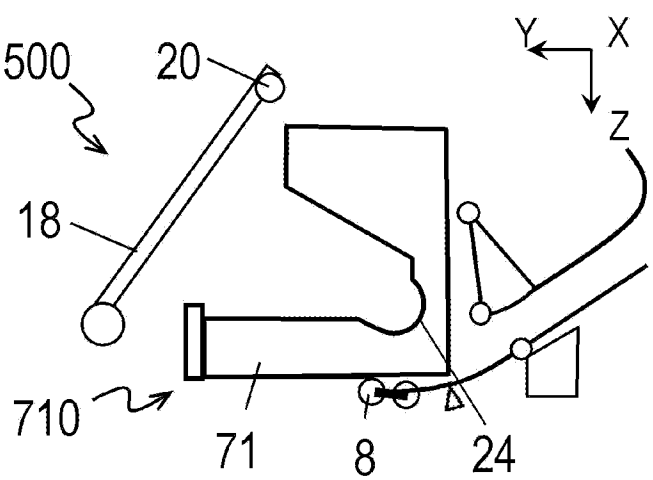
FIGS. 20A to 20D are side views of a paper discharge guide portion and a roll setting portion of a third embodiment.
Figure 20B:
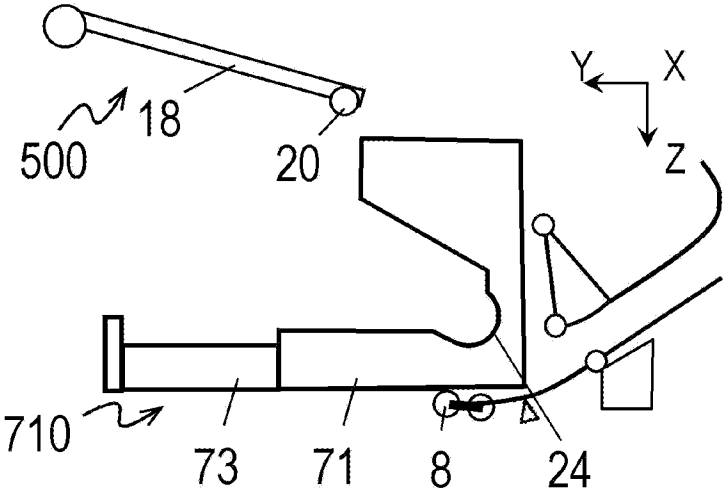

Next, the configuration of the second guide portion 720 that supports the end portion of the attachment member 40 on the non-reference side which is attached to the roll sheet R will be described. FIG. 18A is a perspective view of the second guide portion 720 that supports the attachment member 40 with the second front member 74. FIG. 18B is a perspective view of the second guide portion 720 that supports the attachment member 40 with the second rear member 72. FIG. 19A is a front view of the second front member 74 that supports the attachment member 40. FIG. 19B is a front view of the second rear member 72 that supports the attachment member 40. FIG. 20A is a side view of the second guide portion 720 that supports the attachment member 40 with the second front member 74. FIG. 20B is a side view of the second guide portion 720 that supports the attachment member 40 with the second rear member 72.

The second front member 74 is a substantially square prism member that extends in the front and rear direction (the Y direction) of the recording apparatus 100 and has a similar configuration to the first front member 73. A groove 74*a* is formed in the upper surface of the second front member 74 over the entire area in the projection direction. The groove 74*a* is formed to be able to fit into the spindle gear 45 of the attachment member 40. The width of the groove 74*a* in the left and right direction is larger than the width of the spindle gear 45 in the left and right direction. That is, when the groove 74*a* and the spindle gear 45 are fitted together, a gap is formed between the groove 74*a* and the spindle gear 45 in the left and right direction.

The bottom surface of the groove 74*a* is a second front guide surface 74*b* on which the spindle gear 45 is placed when the second front member 74 supports the attachment member 40. Further, the side surfaces of the groove 74*a* are a third front regulating surface 74*c* and a fourth front regulating surface 74*d* that regulate the movement of the attachment member 40 in the left and right direction (the X direction) when the attachment member 40 is supported by the second front member 74. In other words, the groove 74*a* is constituted by the second front guide surface 74*b* facing upward, the third front regulating surface 74*c* facing the first direction X1, and the fourth front regulating surface 74*d* facing the second direction X2.

When the spindle gear 45 is placed on the second front guide surface 74*b* of the groove 74*a*, the third front regulating surface 74*c* faces an end surface 45*a* of the spindle gear 45 facing the second direction X2, and the fourth front regulating surface 74*d* faces an end surface 45*b* of the spindle gear 45 facing the first direction X1. With this configuration, when the attachment member 40 moves on the second front member 74, the second front member 74 prevents the attachment member 40 from moving diagonally. Furthermore, since a gap is provided between the spindle gear 45 and the groove 74*a*, the operator can place the spindle gear 45 on the groove 74*a* with good work efficiency and can smoothly move the attachment member 40 on the groove 74*a*.

The second front member 74 does not necessarily have to be configured to regulate the movement of the attachment member 40 in the left and right direction. This is because the first front regulating surface 73*c* and the second front regulating surface 73*d* of the first front member 73 regulate the movement of the attachment member 40 in the left and right direction. For example, even in a configuration in which the amount of the gap between the fourth front regulating surface 74*d* and the end surface 45*b* is set to be large and the fourth front regulating surface 74*d* does not substantially function as a regulating portion, the first front member 73 prevents the attachment member 40 from moving diagonally. That is, if a configuration in which at least one regulating portion that regulates the movement of the attachment member 40 in the first direction X1 and at least one regulating portion that regulates the movement of the attachment member 40 in the second direction X2 are provided is used, the attachment member 40 is prevented from moving diagonally. However, in order to improve the work efficiency of moving the attachment member 40 on the guide portion, it is preferable that the second guide portion 720 is also provided with a regulating portion that regulates the movement of the attachment member 40 in one of the left direction and the right direction.

Further, in the second embodiment, the guide portion is configured such that the amount of the gap between the regulating portion of the first guide portion 710 and the attachment member 40 is smaller than the amount of the gap between the regulating portion of the second guide portion 720 and the attachment member 40. This is for the purpose of positioning the attachment member 40 in the left and right direction (the X direction) with respect to the guide portion with higher precision in the first guide portion 710 that holds the reference side of the attachment member 40.

The second rear member 72 includes an inner member 72*a* located on the center side and an outer member 72*b* located on the outer side, in the left and right direction (the X direction) of the recording apparatus 100, and has a similar configuration to the first rear member 71. Both the inner member 72*a* and the outer member 72*b* are members that extend in the front and rear direction (the Y direction) of the recording apparatus 100 and have an L shape in cross section. The inner member 72*a* is disposed such that a long side of the L shape extends in the gravity direction and a short side of the L shape projects from the long side toward the outer member 72*b* in the first direction X1. On the other hand, the outer member 72*b* is disposed such that a long side of the L shape extends in the gravity direction to face the long side of the inner member 72*a* and a short side projects from the long side toward the inner member 72*a* in the second direction X2 to face the short side of the L shape of the inner member 72*a*. That is, a space having a large width is formed between the long side of the inner member 72*a* and the long side of the outer member 72*b*, and a space having a small width is formed between the short side of the inner member 72*a* and the short side of the outer member 72*b*.

An upper surface of the inner member 72*a* is a second rear guide surface 72*c* on which a guide shaft 47 of the attachment member 40 is placed when the attachment member 40 is supported by the second rear member 72. The guide shaft 47 is a shaft portion having a smaller diameter than the spindle 41 and the spindle gear 45 and is located between the spindle 41 and the spindle gear 45. On the other hand, the width of the space of a facing portion between the short side of the inner member 72*a* and the short side of the outer member 72*b* is larger than the width of the spindle gear 45. That is, the attachment member 40 is placed on the second rear member 72 in a state in which the guide shaft 47 is in contact with the second rear guide surface 72*c* and the spindle gear 45 is fitted into the facing portion.

An end surface of the short side of the inner member 72*a* facing the first direction X1 is a third rear regulating surface 72*d* that regulates the movement of the attachment member 40 in the second direction X2. That is, the second guide portion 720 has a third regulating portion that regulates the movement of the attachment member 40 in the second direction X2 across the second rear member 72 and the second front member 74. The third regulating portion is constituted by the third rear regulating surface 72*d* and the third front regulating surface 74*c*.

On the other hand, the outer member 72*b* is configured such that an end surface 72*e* of the short side has a large gap with respect to the end surface 45*b* of the spindle gear 45. That is, the end surface 72*e* does not function as a regulating portion that regulates the movement of the attachment member 40 in the left and right direction. Even in such a configuration, when the attachment member 40 is supported by the first rear member 71 and the second rear member 72, the first rear regulating surface 71*d*, the second rear regulating surface 71*e*, and the third rear regulating surface 72*d* prevent the attachment member 40 from moving diagonally. Furthermore, since a gap is provided between the spindle gear 45 and the second rear member 72, the operator can arrange the spindle gear 45 at the facing portion between the inner member 72*a* and the outer member 72*b* with good work efficiency and can smoothly move the attachment member 40 on the second rear guide surface 72*c*.

Further, as described above, the second front member 74 supports the spindle gear 45 on the second front guide surface 74*b*, and the second rear member 72 supports the guide shaft 47 on the second rear guide surface 72*c*. Regardless of the position of the second front member 74, the second front guide surface 74*b* is formed to at least partially overlap the second rear guide surface 72*c* in the front and rear direction (the Y direction). With this configuration, even while the attachment member 40 moves from above the second front member 74 to above the second rear member 72, the attachment member 40 continues to be supported by the second guide portion 720 at all times.

Further, the second front guide surface 74*b* and the second rear guide surface 72*c* are formed at positions shifted from each other in the gravity direction (the Z direction) and the left and right direction (the X direction). In other words, the second front guide surface 74*b* and the second rear guide surface 72*c* support the attachment member 40 at different positions in the gravity direction (the Z direction) and the left and right direction (the X direction).

The second guide portion 720 is configured such that a height (a distance in the gravity direction) from the second front guide surface 74*b* to the second rear guide surface 72*c* is equal to a difference between a radius of the spindle gear 45 and a radius of the guide shaft 47 of the attachment member 40. With this configuration, the second front member 74 can support the roll sheet R and the attachment member 40 at the same height as the roll sheet R and the attachment member 40 supported by the second rear member 72. Furthermore, the attachment member 40 continues to be supported by the second guide portion 720 at a constant height at all times regardless of its position in the front and rear direction. Therefore, when the operator moves the attachment member 40 from above the second front member 74 to above the second rear member 72, the attachment member 40 moves smoothly without being caught by the second rear member 72. Similarly, when the operator moves the attachment member 40 from above the second rear member 72 to above the second front member 74, the attachment member 40 moves smoothly without being caught by the second front member 74. Furthermore, the operator can set and remove the roll sheet R with respect to the roll setting portion with good work efficiency.

As described above, according to the configuration of the second embodiment, the movement of the attachment member 40 in the left and right direction can be regulated by the regulating portion formed over the entire area of the guide portion in the front and rear direction. Therefore, according to the configuration of the second embodiment, the positioning of the attachment member 40 in the left and right direction can be easily performed, and the attachment member 40 can be prevented from moving diagonally on the guide portion. Furthermore, the operator can set the roll sheet R in the roll setting portion with good work efficiency.

Furthermore, according to the configuration of the second embodiment, the guide portion is configured to be extendable and retractable, but since the front member and rear member of the guide portion support the attachment member 40 at different positions in the axial direction, the roll sheet R and the attachment member 40 are supported by the guide portion at a constant height at all times. Therefore, even if the guide portion is constituted by a plurality of members in the front and rear direction, the attachment member 40 can move without being caught by a protrusion or the like when the attachment member 40 is transferred from one member to the other member. Furthermore, the operator can set the roll sheet R in the roll setting portion or remove the roll sheet R from the roll setting portion with good work efficiency.

Third Embodiment

Next, a third embodiment according to the present invention will be described. The third embodiment differs from the second embodiment in that the paper discharge guide portion 500 operates in conjunction with the guide portion. Hereinafter, in the description of the third embodiment, the same constituent elements as those in the second embodiment will be given the same reference signs, the description thereof will be omitted, and only the characteristic constituent elements of the third embodiment will be described. For example, the configurations of the first guide portion 710 and the second guide portion 720 and the image forming process are the same as those of the second embodiment.

FIGS. 20A to 20D are side views of a paper discharge guide portion 500 and a roll setting portion of the third embodiment. When the roll sheet R is set, the paper discharge guide portion 500 is in an open state, and the guide portion is extended in the front and rear direction (the Y direction) and is in a second state. On the other hand, when the printing operation of the roll sheet R is performed, the paper discharge guide portion 500 is in a closed state, and the guide portion is retracted in the front and rear direction and is in a first state. A recording apparatus of the third embodiment is provided with a drive connection mechanism that changes the state of the guide portion from the first state to the second state as the paper discharge guide portion 500 is opened and changes the state of the guide portion from the second state to the first state as the paper discharge guide portion 500 is closed.

FIG. 20A shows the paper discharge guide portion 500 in the closed state and the first guide portion 710 in the first state. The position of a paper discharge conveyance guide 18 located when the paper discharge guide portion 500 is in the closed state is defined as a first position. When the paper discharge conveyance guide 18 is located at the first position, the paper discharge conveyance guide 18 covers the first guide portion 710 and the holder portion (a spindle holder 24) from a tip end side of the first guide portion 710 in the projection direction. Then, the paper discharge conveyance guide 18 located at the first position can guide the sheet S from a printing portion 400 to a roll setting portion 600 on a winding side. Further, when the first guide portion 710 is in the first state, the first front member 73 is housed inside the first rear member 71.

FIG. 20B shows the paper discharge guide portion 500 in the open state and the first guide portion 710 in the second state. The position of a paper discharge conveyance guide 18 located when the paper discharge guide portion 500 is in the open state is defined as a second position. When the paper discharge conveyance guide 18 is located at the second position, the paper discharge conveyance guide 18 relieves the first guide portion 710 and the holder portion (the spindle holder 24). Then, when the first guide portion 710 is in the second state, the first front member 73 projects forward from the first rear member 71. The paper discharge conveyance guide 18 rotates around a rotation shaft 20 and moves to the second position, and the paper discharge guide portion 500 is in the open state, and thus it is possible to set the roll sheet R in the spindle holder 24 by placing the roll sheet R on the guide portion and moving the roll sheet R on the guide portion via the attachment member 40.

In the third embodiment, the rotation shaft 20 that rotatably supports the paper discharge conveyance guide 18 is connected to a drive portion that drives the first front member 73 and the second front member 74 in the front and rear direction by the drive connection mechanism (not shown). That is, as the rotation shaft 20 rotates, the first front member 73 and the second front member 74 move in the front and rear direction. As the drive connection mechanism or the drive portion of the front members, a known drive means such as a gear, a belt, a rack and pinion, a lead screw, a link mechanism, and the like can be used.

When the state of the recording apparatus is changed from the state shown in FIG. 20A to the state shown in FIG. 20B using the drive connection mechanism described above, the operator only has to perform the work of changing the state of the paper discharge guide portion 500 to the open state. When the paper discharge conveyance guide 18 moves from the first position to the second position, the first front member 73 and the second front member 74 automatically move forward, and the state of the guide portion changes from the first state to the second state. That is, the guide portion also operates in conjunction with the operation of changing the state of the paper discharge guide portion 500 from the closed state to the open state. Furthermore, in the third embodiment, since the number of operations is reduced compared to the second embodiment, the operator can perform the operation of setting the roll sheet R with good work efficiency.

Figure 20C:
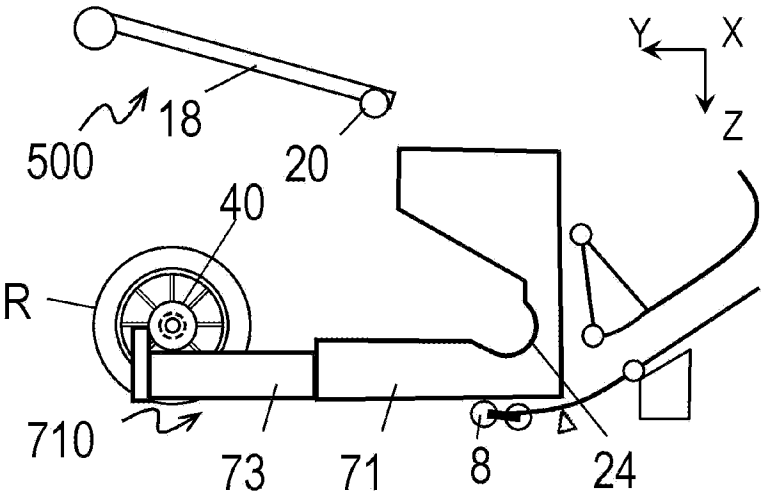

FIG. 20C shows an aspect in which the attachment member 40 attached to the roll sheet R is placed on the guide portion in the second state. Since the paper discharge guide portion 500 is in the open state, the operator can place the attachment member 40 on the first front member 73 and the second front member 74 of the guide portion. Similar to the first embodiment and the second embodiment, a space D which the cart 50 can enter is formed between and below the first guide portion 710 and the second guide portion 720, and the operator can place the attachment member 40 attached to the roll sheet R on the guide portion with good work efficiency. Then, the operator can set the roll sheet R in the spindle holder 24 via the attachment member 40 by rolling or sliding the attachment member 40 on the guide portion.

Figure 20D:
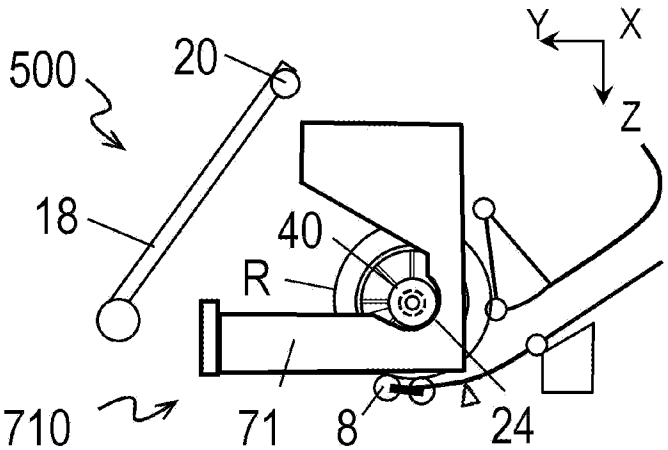

FIG. 20D shows an aspect in which the roll sheet R is set in the spindle holder 24, the paper discharge guide portion 500 is in the closed state, and the guide portion is in the first state. After the roll sheet R is set in the spindle holder 24, the operator rotates the paper discharge conveyance guide 18 to change the state of the paper discharge guide portion 500 to the closed state in order to prepare for the printing operation. When the paper discharge conveyance guide 18 moves from the second position to the first position, the first front member 73 and the second front member 74 automatically move rearward, and the state of the guide portion changes from the second state to the first state. That is, the operator only has to perform the work of changing the state of the paper discharge guide portion 500 to the closed state. Furthermore, in the third embodiment, since the number of operations is reduced compared to the second embodiment, the operator can perform the operation of setting the roll sheet R with good work efficiency.

As described above, according to the configuration of the third embodiment, since the guide portion also operates in conjunction with the operation of the paper discharge guide portion 500, the number of operations required when setting and removing the roll sheet R is reduced, and the work efficiency of setting and removing the roll sheet R is improved. In the above-described configuration, the paper discharge guide portion 500 and the guide portion are physically driven and connected to each other by the drive connection mechanism, but application of the present invention is not limited to the above-mentioned configuration. For example, the guide portion may be configured to be driven by a drive source on the basis of information detected by an opening and closing detection means of the paper discharge guide portion 500.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-196826, filed on Dec. 9, 2022, which is hereby incorporated by reference herein in its entirety.

What is claimed is:

1. A recording apparatus for feeding a sheet from a roll sheet, comprising:

a sheet feeding device including:

a holder portion that rotatably supports the roll sheet around which the sheet to be fed is wound;

a guide portion that guides the roll sheet to the holder portion;

a rear member that is included in the guide portion and projects from the holder portion in a projection direction; and a front member that is included in the guide portion and is configured to move between a projecting position projecting from the rear member in the projection direction and a retracting position retracting to the rear member in a direction opposite to the projection direction; and a recording portion that performs a recording operation on a sheet fed out from the sheet feeding device.

2. The recording apparatus according to claim 1, wherein the holder portion and the guide portion support the roll sheet via an attachment member, and the attachment member is attached to the roll sheet to project from both end portions of the roll sheet in an axial direction.

3. The recording apparatus according to claim 2, wherein, in a case the rear member is a first rear member and the front member is a first front member, the guide portion further includes a second rear member that projects from the holder portion in the projection direction and faces the first rear member and a second front member that is connected to the second rear member to project from the second rear member in the projection direction, and wherein the second front member moves in the projection direction with respect to the second rear member.

4. The recording apparatus according to claim 3, wherein the first rear member has a first rear guide surface on which a first end portion of the attachment member can be placed, wherein the second rear member has a second rear guide surface on which a second end portion of the attachment member can be placed and which is formed on the same plane as the first rear guide surface, wherein the first front member has a first front guide surface on which the first end portion of the attachment member can be placed, and wherein the second front member has a second front guide surface on which the second end portion of the attachment member can be placed and which is formed on the same plane as the first front guide surface.

5. The recording apparatus according to claim 4, wherein the holder portion has a first bearing surface and a second bearing surface that rotatably support the attachment member, a first connection surface that connects the first bearing surface and the first rear guide surface to each other, and a second connection surface that connects the second bearing surface and the second rear guide surface.

6. The recording apparatus according to claim 4, wherein the first rear guide surface supports the attachment member at a position different from the first front guide surface in a gravity direction, wherein the first rear guide surface supports a first shaft portion of the attachment member, wherein the first front guide surface supports a second shaft portion having a different diameter from that of the first shaft portion of the attachment member, and wherein a distance from the first rear guide surface to the first front guide surface in the gravity direction is equal to a difference between a radius of the first shaft portion and a radius of the second shaft portion.

7. The recording apparatus according to claim 6, wherein a part of the first front guide surface overlaps the first rear guide surface in the projection direction.

8. The recording apparatus according to claim 4, wherein a step portion projecting upward from the first front guide surface is provided at a tip end of the first front member in the projection direction, and wherein a step portion projecting upward from the second front guide surface is provided at a tip end of the second front member in the projection direction.

9. The recording apparatus according to claim 3, wherein the guide portion further includes a first regulating portion and a second regulating portion, the first regulating portion comes into contact with the attachment member in a first direction in a facing direction in which the first rear member and the second rear member face each other to regulate movement of the attachment member in a second direction opposite to the first direction, and the second regulating portion comes into contact with the attachment member in the second direction to regulate movement of the attachment member in the first direction.

10. The recording apparatus according to claim 9, wherein the first regulating portion and the second regulating portion are formed across the first rear member and the first front member.

11. The recording apparatus according to claim 10, wherein the guide portion further includes a third regulating portion that comes into contact with the attachment member in the first direction to regulate movement of the attachment member in the second direction, and wherein the third regulating portion is formed across the second rear member and the second front member.

12. The recording apparatus according to claim 1, wherein the front member is configured to be movable to a position where the front member is contained inside the rear member.

13. The recording apparatus according to claim 1, wherein the recording apparatus further comprises a winding portion that is located on the same side of the recording portion as the holder portion in the projection direction and supports a roll that winds up the sheet on which the recording operation has been performed.

14. The recording apparatus according to claim 13, wherein the winding portion is located below the holder portion, wherein the recording apparatus further comprises a sheet guide member that guides the sheet from the recording portion to the winding portion, and wherein the sheet guide member is moveable between a first position where the sheet guide member covers the holder portion from a tip end side of the guide portion in the projection direction and guides the sheet to the winding portion, and a second position at which the holder portion is relieved.

15. The recording apparatus according to claim 14, wherein the guide portion is deformable into a first state in which a length of projection of the guide portion from the holder portion is a first length and a second state in which the length of projection is a second length longer than the first length, and wherein the recording apparatus further comprises a drive connection mechanism that deforms a state of the guide portion from the first state to the second state in conjunction with movement of the sheet guide member from the first position to the second position.

* * * * *